US006250824B1

(12) United States Patent
Ogiyama

(10) Patent No.: US 6,250,824 B1
(45) Date of Patent: Jun. 26, 2001

(54) THERMAL TRANSFER RECORDING METHOD AND THERMAL TRANSFER PRINTER

(75) Inventor: Osamu Ogiyama, Iwate-ken (JP)

(73) Assignee: Alps Electrics Co., Ltd., Tokyo (JP)

( * ) Notice: Subject to any disclaimer, the term of this patent is extended or adjusted under 35 U.S.C. 154(b) by 0 days.

(21) Appl. No.: 09/333,826

(22) Filed: Jun. 15, 1999

(30) Foreign Application Priority Data

Jun. 16, 1998 (JP) ..... 10-168627
Jun. 30, 1998 (JP) ..... 10-277814

(51) Int. Cl.[7] ..... B41J 2/315

(52) U.S. Cl. ..... 400/120.03; 347/172; 347/193; 400/208

(58) Field of Search ..... 400/120.03, 208, 400/194, 120.02; 347/172, 193

(56) References Cited

U.S. PATENT DOCUMENTS 4,704,615 11/1987 Tanaka .
5,467,120 * 11/1995 Sandani et al. ..... 347/171
5,631,688 * 5/1997 Hibino et al. ..... 347/193
5,711,621 * 1/1998 Austin ..... 347/193
5,737,005 * 4/1998 Sawano et al. ..... 347/172
5,807,000 * 9/1998 Kawamura et al. ..... 400/120.02
5,860,751 * 1/1999 Ogasawara ..... 347/193
6,064,414 * 5/2000 Kobayashi et al. ..... 347/172
6,141,028 * 10/2000 Druga ..... 347/193

FOREIGN PATENT DOCUMENTS 63-193861 8/1988 (JP) .
01 063168 3/1989 (JP) .
6-127002 5/1994 (JP) .
07 309 204 11/1995 (JP) .
09 277677 10/1997 (JP) .

* cited by examiner

*Primary Examiner*—Eugene Eickholt
(74) *Attorney, Agent, or Firm*—Brinks Hofer Gilson & Lione

(57) ABSTRACT

A thermal transfer recording method and a thermal transfer printer, which can provide a high quality recorded image by controlling the number of underlying ink printing operations in accordance with the properties of a print sheet, and forming boundaries of adjacent underlying ink layers so that they are out of line with respect to boundaries of adjacent record layers. The thermal transfer printer comprises a setting section for setting the number of underlying ink printing operations; and a controlling section for carrying out a controlling operation such that the number of underlying ink printing operations set by the setting section is carried out. Such a thermal transfer printer can be used to print a sharp image on various types of print sheet.

1 Claim, 9 Drawing Sheets

THERMAL TRANSFER RECORDING METHOD AND THERMAL TRANSFER PRINTER

BACKGROUND OF THE INVENTION

1. Field of the Invention

The present invention relates to a thermal transfer recording method and a thermal transfer printer, and, more particularly, to a thermal transfer recording method and a thermal transfer printer, in which after thermally transferring underlying ink onto a record sheet, recording ink is thermally transferred onto the record sheet, whereby a thermal transfer recording operation is carried out.

2. Description of the Related Art

In general, in conventional thermal transfer printers, a record sheet is supported forwardly of a platen, and a thermal head, formed of a plurality of heating elements, is carried by a carriage. When an ink ribbon and the record sheet are nipped between the thermal head and the platen, and the heating elements of the thermal head are selectively heated, based on recording data, while the thermal head reciprocates along the platen, the ink of the ink ribbon is thermally transferred onto the record sheet, whereby a desired character, or the like, is recorded on the record sheet. Such conventional thermal transfer printers provide high quality printing, has a low noise level, is inexpensive, and is easy to maintain, so that they are frequently used in output devices of, for example, computers or word processors.

Two types of such conventional thermal transfer printers are well known. In the first type, a recording operation is performed on a record sheet with a thermal fusible ink ribbon formed by applying thermal fusible ink onto a resin film, or a base formed of, for example, polyethylene terephtalate (PET). In the second type, a recording operation is performed on a record sheet with a thermal sublimable ink ribbon formed by applying sublimable ink to a base.

When a recording operation is performed with a thermal sublimable ink ribbon, the energy applied to the thermal head is controlled to control adjust the amount by which the thermal sublimable ink is sublimated, whereby the amount of ink transferred onto the record sheet is controlled. This results in adjustment of the density of the image to be recorded on the record sheet. Using, as record sheet, a special sheet subjected to surface treatment, a high-quality and full color image comparable with a silver salt photograph can be obtained.

In recent years, there has been an increasing demand for a thermal sublimation transfer recording method which can be easily carried out to record a high-quality and full color image not only on a sheet formed specially for thermal sublimation transfer recording, but also on generally used record sheets such as post cards and ordinary sheets. When thermal sublimation transfer recording is performed on postcards or ordinary sheets without subjecting them to surface treatment, the thermal sublimable ink does not get transferred onto the postcards or ordinary sheets, so that a high-quality recorded image cannot be obtained. Thermal fusion transfer recording using a thermal fusible ribbon can be performed on an ordinary sheet. However, when a high-quality and full color image needs to be obtained, thermal fusion transfer recording must be performed on a special sheet with a smooth surface, instead of on an ordinary sheet with a rough surface.

To overcome the above-described problem, prior to performing thermal sublimation transfer recording or thermal fusion transfer recording, the surfaces of postcards, ordinary sheets, or the like, are subjected to underlying ink transferring operations to smoothen the sheet surfaces and to make it easier to transfer it thereon.

More specifically, an underlying ink transferring ink ribbon is formed by applying transferring underlying ink onto a resin film, or a base (formed of, for example, PET). The resulting ink ribbon is set in a thermal transfer printer, such as a serial printer, and the ink of the resulting ink ribbon is thermally transferred onto postcards or the like. This results in the production of postcards with a surface which is in general suitable for thermal sublimation transfer recording or thermal fusible transfer recording. When thermal sublimation transfer recording is performed on, for example, postcards subjected to such surface treatment, a high quality image comparable to that produced on sheets formed specially for thermal sublimation transfer recording can be obtained.

However, in underlying ink transferring operations carried out using such a thermal transfer printer, since the amounts of energy to be applied to the heating elements, disposed in the direction of a record sheet line, of the thermal head are controlled such that they are all the same, the ink of the upper and lower edge portions of the underlying ink transferring ink ribbon are not sufficiently transferred.

In other words, since the ink of the underlying ink transferring ink ribbon is hard, it is particularly hard to transfer the ink at the edge portions. Therefore, after the ink has been transferred, the boundary portions between adjacent underlying ink layers in a direction perpendicular to the direction of a record sheet line peel off. This may result in a disrupted image or an image with white streaks appearing at locations corresponding to where peeling has occurred.

To overcome this problem, an underlying ink layer is formed on a next line such that edges of underlying ink layers, formed by an underlying ink transferring ink ribbon on different lines, overlap each other. When thermal sublimation transfer printing (carried out using a thermal sublimable ink ribbon) is performed one line at a time on a record sheet subjected to the underlying ink transferring operation, or when thermal fusion transfer printing (carried out using a thermal fusible ink ribbon) is performed one line at a time on the record sheet subjected to underlying ink transferring operations, a high-quality and full color image can be obtained.

However, in conventional thermal transfer recording methods and thermal transfer printers, the starting location of underlying ink transferring operations and the starting location of recording operations are in line with each other, so that when recording operations are carried out using thermal sublimable or thermal fusible ink on a record sheet, subjected to underlying ink layer operations using a underlying ink transferring ink ribbon, the boundaries between adjacent record layers in a direction perpendicular to the direction of a record sheet line are formed in line with the boundaries between adjacent underlying ink layers in a direction perpendicular to the direction of a record sheet line. To improve image quality, various operations have been performed on the boundary portions between adjacent record layers, formed by the recording ink ribbon, so that each boundary portion does not stand out. When the boundaries between adjacent record layers are formed in line with the boundaries between adjacent underlying ink layers formed above the adjacent underlying ink layers, the recording density at these locations are different from the recording density at the peripheral portions. Therefore, it is no use carrying out operations on the boundary portions to prevent them from standing out. Consequently, even when underlying ink transferring operations are performed, the image quality cannot be improved.

In addition, in conventional thermal transfer recording methods and thermal transfer printers, underlying ink layer operations are performed the same number of times regardless of the sheet type, so that underlying ink transferring operations cannot be carried out in accordance with the properties of a record sheet type. In addition, during recording operations, the ink of a recording ink ribbon cannot be properly transferred onto a record sheet subjected to underlying ink layer transferring operations.

SUMMARY OF THE INVENTION

Accordingly, it is an object of the present invention to provide a thermal transfer recording method and a thermal transfer printer, which can provide a high quality recorded image as a result of controlling the number of underlying ink transferring operations and forming the boundaries between adjacent underlying ink layers, in a direction perpendicular to the direction of a record sheet line, and the boundaries between adjacent record ink layers, in a direction perpendicular to the direction of a record sheet line, such that they are out of line with respect to each other.

According to a first aspect of the present invention, there is provided a thermal transfer recording method comprising the steps of:

moving a thermal head, comprising a plurality of heating elements, along a platen, while the thermal head is press-contacted against the platen, with an underlying ink transferring ink ribbon and a record sheet disposed between the thermal head and the platen; and after repeatedly thermally transferring ink of the underlying ink transferring ink ribbon onto the record sheet in a direction of a record sheet line, ink of a recording ink ribbon is repeatedly thermally transferred onto the record sheet, which has been subjected to the underlying ink transferring operations, by the thermal head, in a direction of a record sheet line, whereby thermal transfer recording operations are carried out;

wherein the underlying ink transferring operations are carried out a plurality of times layer upon layer in accordance with the properties of the record sheet to form different layer levels of underlying ink layers; and wherein boundaries between adjacent underlying ink layers, in a direction perpendicular to the direction of a record sheet line, of each layer level are formed out of line with respect to each other.

Underlying ink transferring operations can be properly carried out in accordance with the properties of a record sheet. Even when a plurality of underlying ink transferring operations are carried out, an improperly recorded image is not produced.

According to a second aspect of the present invention, there is provided a thermal transfer recording method comprising the steps of:

moving a thermal head, comprising a plurality of heating elements, along a platen, while the thermal head is press-contacted against the platen, with an underlying ink transferring ink ribbon and a record sheet disposed between the thermal head and the platen; and after repeatedly thermally transferring ink of the underlying ink transferring ink ribbon onto the record sheet in a direction of a record sheet line, ink of a recording ink ribbon is repeatedly thermally transferred onto the record sheet, which has been subjected to the underlying ink transferring operations, by the thermal head, in the direction of a record sheet line, whereby thermal transfer recording operations are carried out;

wherein the underlying ink transferring operations are carried out a plurality of times layer upon layer in accordance with the properties of the record sheet to form different layer levels of underlying ink layers; and wherein boundaries between adjacent underlying ink layers, in a direction perpendicular to the direction of a record sheet line, of a layer level, when the underlying ink transferring operations are being carried out, are formed out of line with respect to boundaries between adjacent record layers in a direction perpendicular to the direction of a record sheet line.

The boundaries between adjacent record ink layers and the boundaries between adjacent underlying ink layers of a layer level are formed out of line with respect to each other. Therefore, a properly recorded image can be obtained.

In one form of the first aspect of the present invention, the underlying ink transferring operations may be carried out layer upon layer a suitable number of times in accordance with the properties of the record sheet; and the boundaries between adjacent underlying ink layers of each layer level may be formed out of line with respect to each other. The boundaries between adjacent underlying ink layers of a layer level may be formed so that they are not formed in line with respect to the boundaries between adjacent record layers in a direction perpendicular to the direction of a record sheet line.

In the one form of the first aspect, a properly recorded image can be obtained.

In another form of the first aspect of the present invention, a plurality of underlying ink transferring operations may be carried out; and when recording operations are carried out layer upon layer to form different layer levels of record ink layers using a plurality of recording ink ribbon types, boundaries between adjacent topmost underlying ink layers may be formed out of line with respect to at least boundaries between adjacent record layers which are the first layer level of record layers to be formed above the topmost underlying ink layers.

With the image quality being maintained, the number of controlling operations carried out to control the underlying ink transferring operations and the recording operations can be reduced to the minimum required, thereby simplifying the controlling operations.

In still another form of the first aspect of the present invention, when recording operations are carried out layer upon layer to form different layer levels of record ink layers using a plurality of recording ink ribbon types, boundaries between adjacent record layers of each layer level may be formed out of line with respect to each other.

In this form of the first aspect, a properly recorded image can be obtained.

According to a third aspect of the present invention, there is provided a thermal transfer recording method comprising the steps of:

moving a thermal head, comprising a plurality of heating elements, along a platen, while the thermal head is press-contacted against the platen, with an underlying ink transferring ink ribbon and a record sheet disposed between the thermal head and the platen; and after repeatedly thermally transferring ink of the underlying ink transferring ink ribbon onto the record sheet in the direction of a record sheet line, ink of a recording ink ribbon is repeatedly thermally transferred onto the record sheet, which has been subjected to the underlying ink transferring operations, by the thermal head, in the direction of a record sheet line, whereby thermal transfer recording operations are carried out;

wherein the underlying ink transferring operations are carried out a plurality of times layer upon layer in accordance with the properties of the record sheet to form different layer levels of underlying ink layers; and wherein when a plurality of color ink ribbons including at least a cyan ink ribbon, a magenta ink ribbon, and a yellow ink ribbon, are used, boundaries between adjacent underlying ink layers, in a direction perpendicular to the direction of a record sheet line, of a layer level are formed in line with respect to boundaries between adjacent yellow record layers in a direction perpendicular to the direction of a record sheet line, when the recording operations using the yellow ink ribbon is carried out.

The boundaries between adjacent underlying ink layers of a layer level are formed in line with respect to the boundaries between adjacent yellow record layers, which come in shades that do not vary greatly. Therefore, with the image quality maintained, the controlling operations carried out to control underlying ink transferring operations and recording operations can be simplified.

In one form of the third aspect of the present invention, the first recording operations on the topmost underlying ink layers may be carried out using a recording ink ribbon other than the yellow ink ribbon.

Even when a plurality of underlying ink transferring operations are carried out, controlling operations carried out to control underlying ink transferring operations and recording operations can be simplified, while maintaining the image quality.

In the thermal transfer recording method, in which the first recording operations on the topmost underlying ink layers are carried out using a recording ribbon other than the yellow ink ribbon, the recording operations may be carried out using a black ink ribbon, in addition to using the cyan ink ribbon, the magenta ink ribbon, and the yellow ink ribbon; and boundaries between adjacent underlying ink layers, in a direction perpendicular to the direction of a record sheet line, formed below the topmost underlying ink layers may be formed in line with respect to boundaries between black record layers formed using the black ink ribbon.

The boundaries between adjacent black record layers formed, which are used in the smallest amount when recording, are formed in line with respect to the boundaries between adjacent underlying ink layers formed below the topmost underlying ink layers. Therefore, even when a plurality of ink underlying transferring operations are carried out, the controlling operations carried out to control underlying ink transferring operations and recording operations can be simplified, while maintaining the image quality.

According to a fourth aspect of the present invention, there is provided a thermal transfer printer wherein a thermal head, comprising a plurality of heating elements, is carried by a carriage so as to oppose a platen, and the carriage is moved along the platen, while the thermal head is press-contacted against the platen, with an underlying ink transferring ink ribbon and a record sheet being disposed between the thermal head and the platen; wherein after repeatedly thermally transferring ink of the underlying ink transferring ink ribbon onto the record sheet by the thermal head in the direction of a record sheet line, ink of a recording ink ribbon is repeatedly thermally transferred onto the record sheet, which has been subjected to the underlying ink transferring operations, by the thermal head in the direction of a record sheet line;

wherein the thermal transfer printer comprises controlling means for performing controlling operations such that the underlying ink transferring operations are carried out a plurality of times layer upon layer in accordance with the properties of the record sheet to form different layer levels of underlying ink layers, and such that boundaries between adjacent underlying ink layers, in a direction perpendicular to the direction of a record sheet line, of each layer level are formed out of line with respect to each other.

Underlying ink transferring operations can be properly carried out in accordance with the properties of a record sheet. Therefore, even when a plurality of underlying ink transferring operations are carried out, an improperly recorded images is not produced.

According to a fifth aspect of the present invention, there is provided a thermal transfer printer, wherein a thermal head, comprising a plurality of heating elements, is carried by a carriage so as to oppose a platen, and the carriage is moved along the platen, while the thermal head is press-contacted against the platen, with an underlying ink transferring ink ribbon and a record sheet being disposed between the thermal head and the platen; wherein after repeatedly thermally transferring ink of the underlying ink transferring ink ribbon onto the record sheet by the thermal head in the direction of a record sheet line, ink of a recording ink ribbon is repeatedly thermally transferred onto the record sheet, which has been subjected to the underlying ink transferring operations, by the thermal head in the direction of a record sheet line;

wherein the thermal transfer printer comprises controlling means for carrying out controlling operations such that the underlying ink transferring operations are carried out a plurality of times layer upon layer in accordance with the properties of the record sheet to form different layer levels of underlying ink layers, and such that boundaries between adjacent underlying ink layers, in a direction perpendicular to the direction of a record sheet line, of a layer level, when the underlying ink transferring operations are being carried out, are formed out of line with respect to boundaries between adjacent record layers in the direction of a record sheet line.

When recording operations are carried out, the boundaries between adjacent record layers and the boundaries between adjacent underlying ink layers of a layer level are formed out of line with respect to each other. Therefore, a properly recorded image can be obtained.

In one form of the fourth aspect, the thermal transfer printer may comprise controlling means for performing controlling operations such that the underlying ink transferring operations are carried out a plurality of times layer upon layer in accordance with the properties of the record sheet to form different layer levels of underlying ink layers, and such that boundaries between adjacent underlying ink layers, in a direction perpendicular to the direction of a record sheet line, of a layer level, when the underlying ink transferring operations are being carried out, are formed out of line with respect to boundaries between adjacent record layers in a direction perpendicular to the direction of a record sheet line.

In this form of the fourth aspect, a properly recorded image can be obtained.

In another form of the fourth aspect, the thermal transfer printer may comprise controlling means for performing controlling operations such that when recording operations are carried out layer upon layer to form different layer levels of record ink layers using a plurality of recording ink ribbon types, boundaries between adjacent topmost underlying ink layers are out of line with respect to at least boundaries between adjacent record layers which are the first layer level of record layers to be formed above the topmost underlying ink layers.

In this form of the fourth aspect, with the image quality maintained, the number of controlling operations carried out to control underlying ink transferring operations and recording operations can be reduced to the minimum required, thereby simplifying the controlling operations.

In still another form of the fourth aspect, the thermal transfer printer may comprise controlling means for performing controlling operations such that when recording operations are carried out layer upon layer to form different layer levels of record ink layers using a plurality of recording ink ribbon types, boundaries between adjacent record layers of each layer level are formed out of line with respect to each other.

In this form of the fourth aspect, a properly recorded image can be obtained.

According to a sixth aspect of the present invention, there is provided a thermal transfer printer wherein a thermal head, comprising a plurality of heating elements, is carried by a carriage so as to oppose a platen, and the carriage is moved along the platen, while the thermal head is press-contacted against the platen, with an underlying ink transferring ink ribbon and a record sheet being disposed between the thermal head and the platen; wherein after repeatedly thermally transferring ink of the underlying ink transferring ink ribbon onto the record sheet by the thermal head in the direction of a record sheet line, ink of a recording ink ribbon is repeatedly thermally transferred onto the record sheet, which has been subjected to the underlying ink transferring operations, by the thermal head in the direction of a record sheet line;

wherein the thermal transfer printer comprises controlling means for performing controlling operations such that the underlying ink transferring operations are carried out a plurality of times layer upon layer in accordance with the properties of the record sheet to form different layer levels of underlying ink layers, and such that when a plurality of color ink ribbons including at least a cyan ink ribbon, a magenta ink ribbon, and a yellow ink ribbon, are used, boundaries between adjacent underlying ink layers, in a direction perpendicular to the direction of a record sheet line, of a layer level are formed in line with respect to boundaries between adjacent yellow record layers in a direction perpendicular to the direction of a record sheet line, when the recording operations using the yellow ink ribbon is carried out.

The boundaries between adjacent underlying ink layers of a layer level are formed in line with respect to the boundaries between adjacent yellow record layers, which come in shades which do not vary very greatly. Therefore, the controlling operations carried out to control underlying ink transferring operations and recording operations can be simplified, while maintaining the image quality.

In one form of the sixth aspect of the present invention, a controlling operation may be carried out such that the first recording operations on the topmost underlying ink layers are carried out using a recording ink ribbon other than the yellow ink ribbon.

In this form of the sixth aspect, even when a plurality of underlying ink transferring operations are carried out, the controlling operations carried out to control the underlying ink transferring operations and recording operations can be simplified, while maintaining the image quality.

According to the thermal transfer printer, in which a controlling operation may be carried out such that the first recording operations on the topmost underlying ink layers are carried out using a recording ink ribbon other than the yellow ink ribbon, the recording operations may be carried out using a black ink ribbon, in addition to using the cyan ink ribbon, the magenta ink ribbon, and the yellow ink ribbon; and boundaries between adjacent underlying ink layers, in a direction perpendicular to the direction of a record sheet line, formed below the topmost underlying ink layers may be formed in line with respect to boundaries between black record layers formed using the black ink ribbon.

The boundaries between adjacent black record layers, which is used in the smallest amount when recording, and the boundaries between adjacent underlying ink layers below the topmost underlying ink layers are formed in line with respect to each other. Therefore, even when a plurality of underlying ink transferring operations are carried out, the controlling operations carried out to control underlying ink transferring operations and recording operations can be simplified even further, while maintaining the image quality.

According to a seventh aspect of the present invention, there is provided a thermal transfer printer in which a plurality of ink ribbons are used to carry out an underlying ink transferring operation, as required, to form an underlying ink layer by a thermal head, and printing is carried out on the underlying ink layer using a predetermined color ink ribbon by the thermal head, the thermal transfer printer comprising:

a setting section for setting the number of underlying ink printing operations to be carried out on a same location; and a controlling section for carrying out a controlling operation so that the number of underlying ink printing operations set at the setting section is carried out.

The number of underlying ink printing operations can be set to print a sharp image on different types of print sheets.

In one form of the seventh aspect, the setting section may select the number of underlying ink printing operations in accordance with print sheet types.

The number of underlying ink printing operations can be set in accordance with print sheet type, so that a sharp image can be printed without wasting underlying ink transferring printing ink ribbons.

In another form of the seventh aspect, the setting section may select the number of underlying ink printing operations in accordance with image types to be printed using the predetermined color ink.

Proper underlying ink printing operations can be carried out to print a proper image.

In still another form of the seventh aspect, one underlying ink printing ribbon cassette may be used to carry out the underlying ink printing operations.

Since only one underlying ink transferring ribbon cassette is used, the space required for ribbon cassette installation can be made small.

In still another form of the seventh aspect, a plurality of underlying ink printing ribbon cassettes may be used to carry out the underlying ink printing operations.

Since a plurality of ribbon cassettes are used to carry out underlying ink printing operations, it is not necessary to replace underlying ink transferring ribbon cassettes so frequently.

DESCRIPTION OF THE PREFERRED EMBODIMENTS

Figure 1:
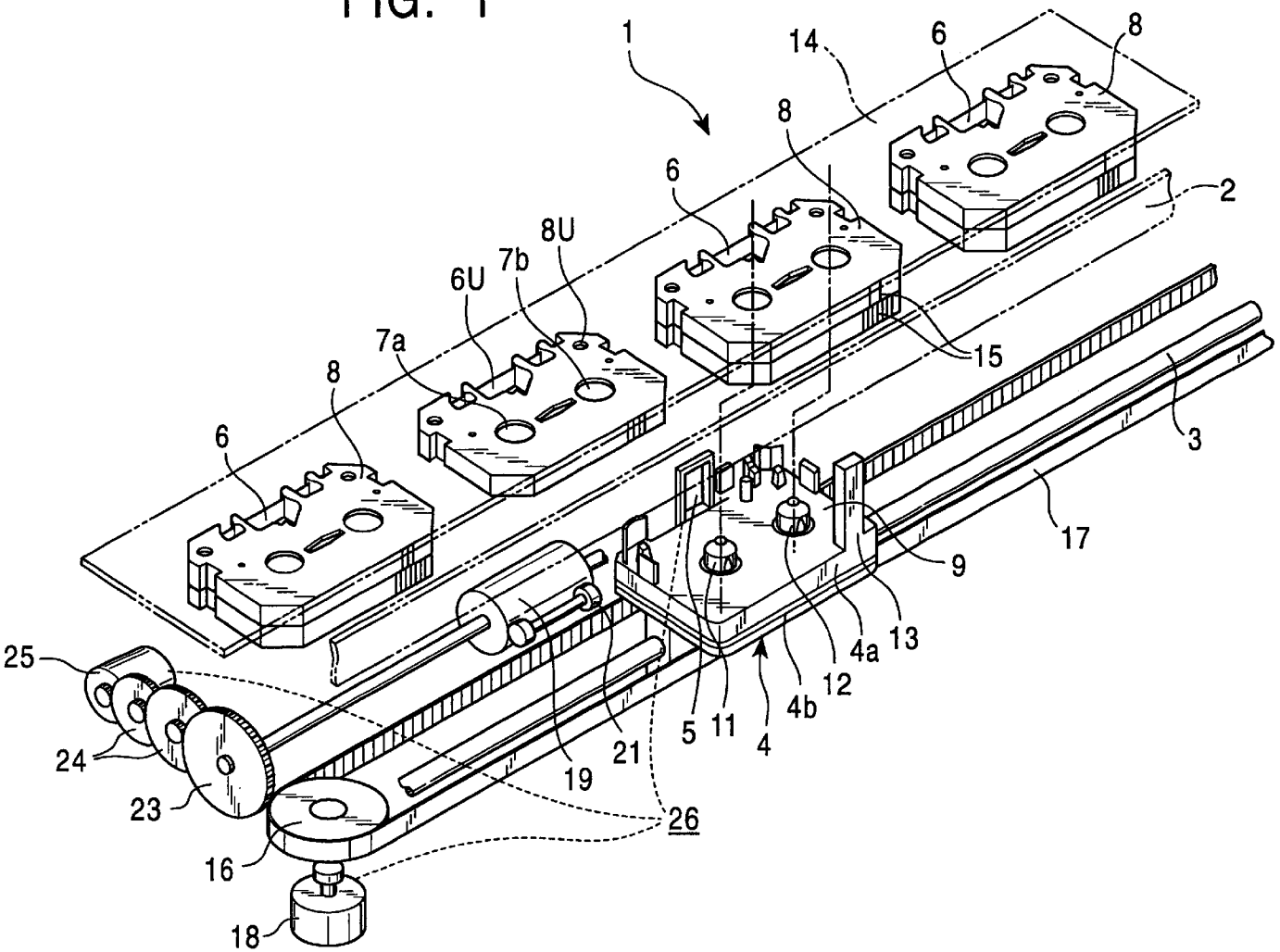
FIG. 1 is a perspective view of a first embodiment of the thermal transfer printer in accordance with the present invention.

A description will now be given of a first embodiment of the thermal printer used to carry out a thermal transfer recording method in accordance with the present invention, with reference to FIGS. 1 to 16.

In the first embodiment, the thermal transfer printer 1 comprises a platen 2 provided at a predetermined location of a frame (not shown). A surface, facing the side at which recording is carried out, of the platen 2 extends substantially vertically. A carriage shaft 3, formed parallel to the platen 2, is disposed in front of and downwardly of the platen 2. A carriage 4, comprising an upper carriage portion 4*a* and a lower carriage portion 4*b*, is mounted to the carriage shaft 3 so that it can reciprocate along the platen 2. A thermal head 5, in which a plurality of heating elements are arranged in a row, is carried at the portion of the carriage 4*a* opposing the platen 2. The top surface of the upper carriage portion 4*a* is formed as a cassette placing surface 9 for placing a ribbon cassette 8 thereon. An ink ribbon 6, wound around a take-up core 7*a* and a supply core 7*b*, is housed in the ribbon cassette 8. A take-up bobbin 11 and a supply bobbin 12 are rotatably disposed on the cassette placing surface 9. They engage the take-up core 7*a* (for taking up the ink ribbon 6 wound around the cores 7*a* and 7*b* by a driving operation) and the supply core 7*b* of the ribbon cassette 8, respectively. A photosensor 13, used for identifying the ribbon cassette type of a ribbon cassette 8, is provided at one corner of the cassette placing surface 9. A cassette receiving mechanism (not shown) is provided between the lower carriage portion 4*b* and the upper carriage portion 4*a* in order to receive the desired type of ribbon cassette 8 and to place it on the cassette placing surface 9 as a result of moving the upper carriage portion 4*a* upward.

A cassette holding plate 14, for holding ribbon cassettes 8, are disposed above the carriage 4 so as to face the carriage 4. A plurality of cassette accommodating mechanisms (not shown), for accommodating the ribbon cassettes 8, are disposed on the cassette holding plate in a row in a direction of movement of the carriage 4. Each cassette accommodating mechanism can accommodate two ribbon cassettes 8, which are placed upon each other. More specifically, the cassette accommodating mechanisms accommodate four types of recording ribbon cassettes 8 and underlying ink transferring ribbon cassettes 8U. In the first type of recording ribbon cassette 8, a cyan (C) ink ribbon 6 is wound therein. In the second type, a magenta (M) ink ribbon 6 is wound therein. In the third type, a yellow (Y) ink ribbon 6 is wound therein. In the fourth type, a black (BK) recording ribbon 6 is wound therein. The ink ribbons 6 housed in the four types of ribbon cassettes are all thermal sublimable ink ribbons 6. Each ink ribbon cassette 6U is used when transferring underlying, and has an ink ribbon 6U wound and housed therein. A marker 15, formed of, for example, a reflecting film, is formed on a side surface of each ribbon cassette 8 in order to indicate the ribbon cassette type of each ribbon cassette 8. The photosensor 13 detects light reflected from a marker 15 in order to identify ribbon cassette type.

A drive belt 17, wound on a pair of pulleys 16, is disposed forwardly of the platen 2, with one edge of the drive belt 17 being affixed to the carriage 4. A carriage motor 18, being a stepping motor, is coupled to one of the pulleys 16. The drive power of the carriage motor 18 is transmitted to the drive belt 17 through the pulley 16.

A transporting roller 19, for transporting a record sheet P between the platen 2 and the thermal head 5, is rotatably disposed below the platen 2. A press-contact roller 21 press-contacts the outer peripheral surface of the transporting roller 19. Accordingly, the record sheet P is nipped between the press-contact roller 21 and the transporting roller 19 when it is being transported. A transporting roller gear 23 is disposed at one side (or at the left side) of a rotary shaft 22 provided at the transporting roller 19, and is coupled to a sheet feed motor 25, acting as a drive source, through a plurality of transmitting gears 24.

The thermal transfer printer 1 comprises a control unit 26, acting as controlling means, for performing various controlling operations when recording operations and underlying ink transferring operations are being carried out.

Figure 2:
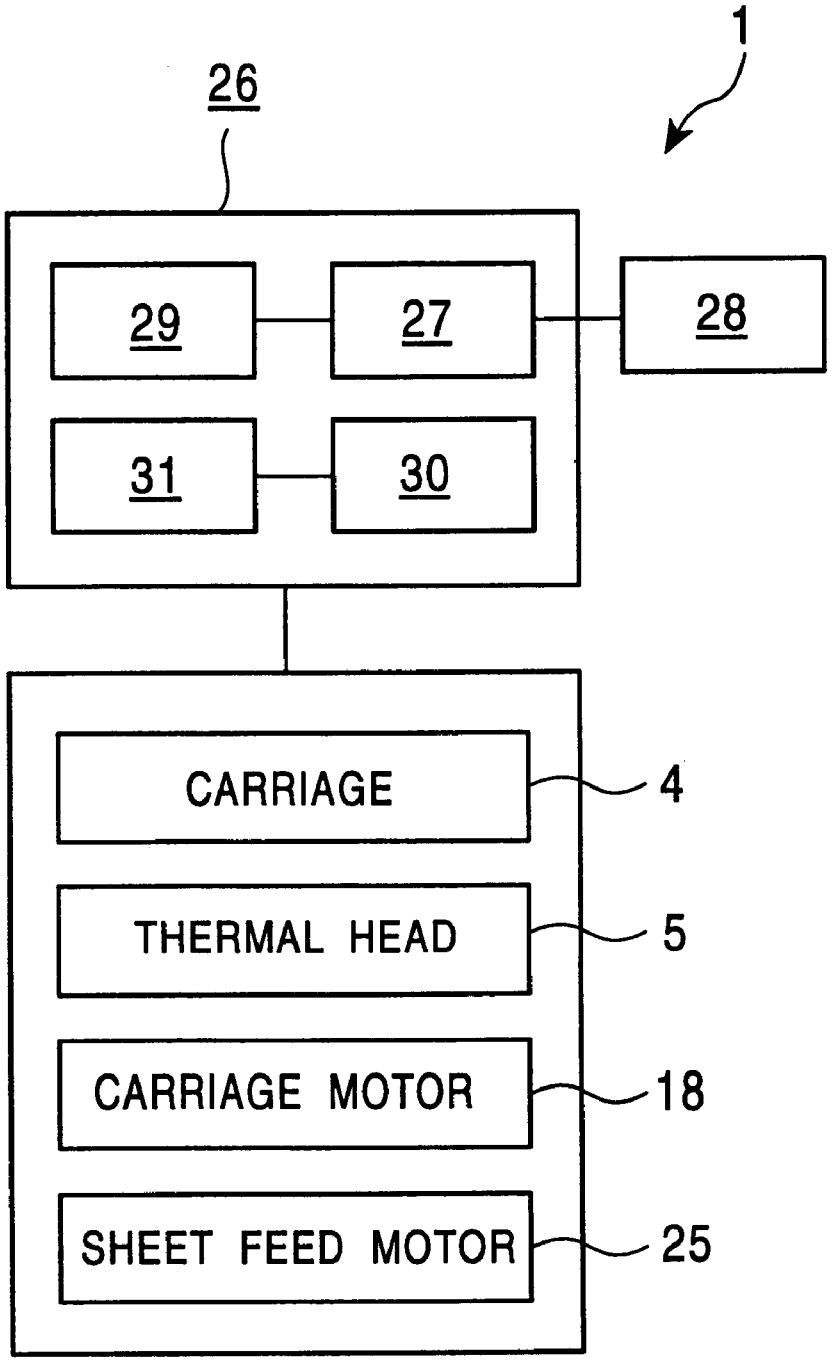
FIG. 2 is a block diagram of the component parts of the means for controlling the underlying ink transferring operations and the recording operations, used in the first embodiment of the thermal transfer printer in accordance with the present invention.

As shown in FIG. 2, the control unit 26 comprises an underlying ink transferring operation control section 27 for controlling underlying ink transferring operations. The underlying ink transferring operation control section 27 is coupled to a record sheet mode input switch 28 used for inputting information regarding the type of record sheet P to be subjected to underlying ink transferring operations. The underlying ink transferring operation control section 27 is formed so as to receive an input signal from the record sheet mode input switch 28 and to determine the number of underlying ink transferring operations required based on the type of record sheet P. The underlying ink transferring operation control section 27 gives out a command to a cassette receiving mechanism at the carriage 4 to receive a ribbon cassette 8U. After the underlying ink transferring ribbon cassette 8U has been placed on the carriage 4, the control section 27 gives out a control command to the thermal head 5 to thermally transfer the ink of the ink ribbon 6U in the ribbon cassette 8U onto the record sheet P. After the underlying ink transferring operation for one line has been completed, and line feeding of the record sheet P is carried out, the underlying ink transferring operation control section 27 controls the amount by which the record sheet P is transported so that ends of underlying ink layers, adjacent each other in a direction perpendicular to the direction of a record sheet line, overlap each other by an amount corresponding to a few number of dots. In the case where a plurality of underlying ink transferring operations are to be carried out, the control section 27 controls the amount by which the record sheet P is transported so that the boundaries between adjacent underlying ink layers of one layer level and the boundaries between adjacent underlying ink layers of another layer level are formed out of line, when underlying ink is being transferred.

An underlying ink layer edge correcting section 29 is connected to the underlying ink transferring operation control section 27 in order to correct the heating area in the thermal head, at an underlying ink transferring operation starting location and at an underlying ink transferring operation ending location, when a plurality of underlying in transferring operations are to be carried out.

The control unit 26 also comprises a recording operation control section 30 for controlling thermal transfer recording carried out by the thermal head.

The recording operation control section 30 is constructed to give out a command to the cassette receiving mechanism at the carriage 4 to receive a ribbon cassette 8. After the ribbon cassette 8 has been placed on the carriage 4, the recording operation control section 30 gives out a command to the thermal head 5 to thermally transfer the ink of the ink ribbon 6 onto the record sheet P. When a recording operation for one line has been completed, and line feeding of the record sheet P is to be carried out, the recording operation control section 30 controls the amount by which the record sheet P is transported such that ends of record layers, adjacent each other in a direction perpendicular to the direction of a record sheet line, overlap each other by an amount corresponding to a few number of dots. In the embodiment, recording operations are carried out by successively placing upon each other the ink of the cyan ink ribbon 6, the ink of the magenta ink ribbon 6, the ink of the yellow ink ribbon 6, and the ink of the black ink ribbon 6. When the record layers are formed by the ink ribbons 6, the recording operation control section 30 controls the amount by which the record sheet P is transported each time a recording operation is carried out to form a record layer by each ink ribbon 6 such that the boundaries between adjacent record layers of one layer level and the boundaries between adjacent record layers of another layer level are formed out of line, in the vertical direction.

A recording edge correcting section 31 is coupled to the recording operation control section 30 in order to correct the heating area of the thermal head, at a starting location and an ending location of recording operations using the cyan ink ribbon 6, the magenta ink ribbon 6, the yellow in ribbon 6, and the black ink ribbon 6.

A description will now be given of a thermal transfer recording method carried out by the first embodiment of the thermal transfer printer in accordance with the present invention.

Information indicating the type of record sheet P (such as information indicating that the record sheet P is a postcard) is input by the record sheet mode input switch 28. Then, the input information is output to the underlying ink transferring operation control section 27, which determines the optimum number of underlying ink transferring operations to be carried out on the record sheet P. In the embodiment, two sets of underlying ink transferring operations are carried out.

The underlying ink transferring operation control section 27 causes the carriage 4 to move along the platen 2 as a result of driving the carriage motor 18. When the photosensor 13 detects a ribbon cassette 8U, the carriage motor 18 stops. At this time, one cassette accommodating mechanism, in which the ribbon cassette 8U is accommodated, is disposed above the carriage 4. Then, the underlying ink transferring operation control section 27 causes the upper carriage 4*a* to move upward as a result of driving the cassette receiving mechanism provided at the carriage 4, after which the ribbon cassette 8U is placed on the cassette placing surface 9.

Thereafter, the underlying ink transferring operation control section 27 causes the transporting roller 19 to rotate as a result of driving the sheet feed motor 25. The first line of the record sheet P (to be subjected to underlying ink transferring operations) is transported between the platen 2 and the thermal head 5. After the record sheet P has been transported, the carriage 4 is moved along the platen 2 as a result of driving the carriage motor 18, while the thermal head 5 is press-contacted against the platen 2. Here, the ink ribbon 6U and the recording sheet P are nipped between the thermal head 5 and the platen 2. The control section 27 causes heating elements of the thermal head 5 located within an area corresponding to one line to be heated in order to cause the ink of the ink ribbon 6U to be thermally transferred onto the record sheet P. This forms an underlying ink layer along one line, on the first line of the record sheet.

Figure 3:
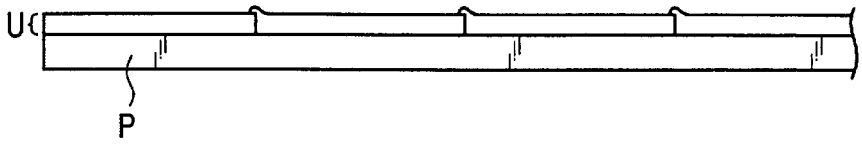
FIG. 3 illustrates a state in which a first set of underlying ink transferring operations is completed, in the first embodiment of the thermal transfer printer in accordance with the present invention.

When an underlying ink layer has been formed on the first line of the record sheet P. the transporting roller 19 is rotated as a result of driving the sheet feed motor 25 again. The second line of the record sheet P is transported between the platen 2 and the thermal head 5. Here, the underlying ink transferring operation control section 27 controls the amount by which the record sheet P is transported so that the bottom edge of the underlying ink layer formed on the first line overlaps the top edge of an underlying ink layer formed on the second line by an amount corresponding to a few dots. Then, the carriage is moved along the platen 2 as a result of driving the carriage motor 18, while the thermal head 5 is press-contacted against the platen 2. Here, the ink ribbon 6U and the record sheet P are nipped between the thermal head 5 and the platen 2. Afterwards, heating elements of the thermal head are heated in order to thermally transfer the ink of the ink ribbon 6 onto the record sheet P. Accordingly, an underlying ink layer is formed along one line on the second line such that the bottom edge of the underlying ink layer formed along one line on the first line overlaps the top edge of the underlying ink layer formed on the second line by an amount corresponding to a few dots. These operations are repeated to complete a first set of underlying ink transferring operations performed on the record sheet P, whereby edges of underlying ink layers, adjacent each other in a direction perpendicular to the direction of a record sheet line, overlap each other in the vertical direction at the boundary between adjacent underlying ink layers disposed in a direction perpendicular to the direction of a record sheet line, as shown in FIG. 3.

Figure 4:
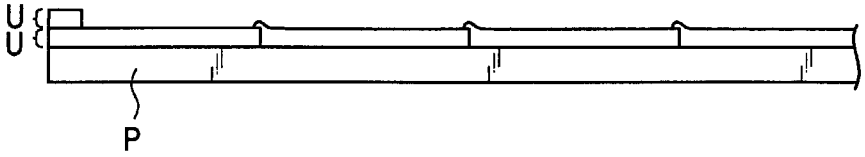
FIG. 4 illustrates a state in which the first line underlying ink layer is formed during a second set of underlying ink transferring operations, in the first embodiment of the thermal transfer printer in accordance with the present invention.

After completion of the first set of underlying ink transferring operations on the record sheet P, the control section 27 causes the record sheet P to be transported in a direction opposite to the transporting direction of the record sheet P as a result of driving the sheet feed motor 25, in order to return the portion of the record sheet P where the first line underlying ink layer is formed between the thermal head 5 and the platen 2. While the thermal head 5 is press-contacted against the platen 2 (with the ink ribbon 6U and the record sheet P being nipped therebetween), the carriage 4 is moved along the platen 2 as a result of driving the carriage motor 18. At this time, the control section 27 causes heating elements located within a predetermined area of the thermal head 5 to be heated in order to thermally transfer the ink of the ink ribbon 6 onto the record sheet P. Here, the predetermined heating area of the thermal head 5 is corrected, by the underlying ink layer edge correcting section 29 to, for example, a size corresponding to one-sixth of one line. As shown in FIG. 4, this causes ink to be thermally transferred onto the top of the first line underlying ink layer, formed during the first set of underlying ink transferring operations, with an area corresponding to one-sixth of one line from the left end in FIG. 4.

Thereafter, the underlying ink transferring operation control section 27 causes the transporting roller 19 to rotate as a result of driving the sheet feed motor 25, in order to transport the record sheet P by an amount corresponding to the number of dots which is slightly less than the number of dots corresponding to one-sixth of one line. While the thermal head 5 is press-contacted against the platen 2 (with the ink ribbon 6U and the record sheet P being nipped therebetween), the carriage 4 is moved along the platen 2 as a result of driving the carriage motor 18, and the thermal head 5 is heated to thermally transfer the ink of the ink ribbon 6 onto the record sheet P. This causes a second line underlying ink layer to be formed along one line such that the bottom edge of the first line underlying ink layer overlaps the top edge of the second line underlying ink layer by an amount corresponding to a few number of dots. Then, the control section 27 causes the record sheet P to be transported by the number of dots which is less than that corresponding to one line as a result of driving the sheet motor 25, in order to carry out an underlying ink layer operation. This causes a third line underlying ink layer to be formed along one line so that the bottom edge of the second line underlying ink layer overlaps the top edge of the third line underlying ink layer. The transportation of the record sheet P by an amount corresponding to the number of dots which is less than one line is subsequently repeated, whereby underlying ink layers are successively formed along one line. After the last line of the record sheet P has been transported between the thermal head 5 and the platen 2, the underlying ink layer edge correcting section 29 corrects the heating area of the thermal head 5 to a size corresponding to five-sixth of one line, whereby the last underlying ink layer is formed so as to extend along five-sixth of one line.

Figure 5:
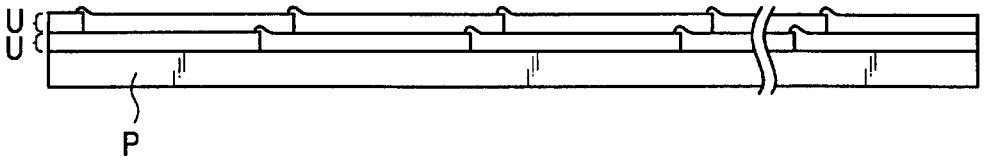
FIG. 5 illustrates a state in which the second set of underlying ink transferring operations is completed, in the first embodiment of the thermal transfer printer in accordance with the present invention.

As shown in FIG. 5, when the second set of underlying ink transferring operations are completed, the boundaries between adjacent underlying ink layers, formed by the first set of underlying ink transferring operations, and the boundaries between adjacent underlying ink layers, formed by the second set of underlying ink transferring operations, are one-sixth of one line apart. The starting location and the ending location of the first set of underlying ink transferring operations and those of the second set of underlying ink transferring operations are in line with respect to each other.

A description will now be given of a recording operation performed on the record sheet P, which has been subjected to the first and second sets of underlying ink transferring operations, using the ink ribbon 6U. In the embodiment, recording operations are carried out using the cyan ink ribbon 6, the magenta ink ribbon 6, the yellow ink ribbon 6, and the black ink ribbon 6, in that order, such that the boundaries between adjacent record layers of one layer level and those between adjacent record layers of the next layer level are one-sixth of one line apart.

The recording operation control section 30 causes the carriage 4 to be moved along the platen 2 as a result of driving the carriage motor 18. When the photosensor 13 detects the cyan recording ribbon cassette 8, the carriage motor 18 stops. Here, one cassette accommodating mechanism, in which the cyan recording ribbon cassette 8 is accommodated, is disposed above the carriage 4. The recording operation control section 30 then causes the upper carriage portion 4*a* to move upward as a result of driving the cassette receiving mechanism provided at the carriage 4, in order to place the cyan recording ribbon cassette 8 on the cassette placing surface 9.

Figure 6:
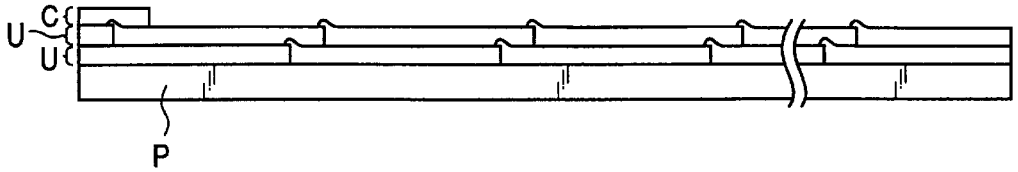
FIG. 6 illustrates a state in which the first line layer is formed using the cyan ink ribbon, in the first embodiment of the thermal transfer printer in accordance with the present invention.

Thereafter, the control section 30 causes the transporting roller 19 to rotate as a result of driving the sheet feed motor 25, in order to transport the first line of the record sheet P between the platen 2 and the thermal head 5. After the record sheet P has been transported, the carriage 4 is moved along the platen 2 as a result of driving the carriage motor 18, while the thermal head 5 is press-contacted against the platen 2 (with the cyan ink ribbon 6 and the record sheet P being nipped therebetween). At this time, the recording operation control section 30 causes heating elements within a predetermined area of the thermal head 5 to be heated in order to thermally transfer the ink of the cyan ink ribbon 6 onto the record sheet P. Here, the heating area of the thermal head 5 is corrected by the recording edge correcting section 31 to a size corresponding to two-sixth of one line. As shown in FIG. 6, the cyan ink is thermally transferred onto the first line underlying ink layers, formed during the second set of underlying ink transferring operations, with an area equal to two-sixth of one line from the left end in FIG. 6.

The recording operation control section 30 causes the transporting roller 19 to rotate as a result of driving the sheet feed motor 25, in order to transport the record sheet p by an amount corresponding the number of dots which is slightly less than that corresponding to two-sixth of one line. Then, while the thermal head 5 is press-contacted against the platen 2 (with the ink ribbon 6 and the record sheet P nipped therebetween), the control section 30 causes the carriage 4 to move along the platen 2 as a result of driving the carriage motor 18. Thereafter, heating elements of the thermal head 5 are heated in order to thermally transfer the ink of the ink ribbon 6 onto the record sheet P. This causes a second line record layer to be formed such that the bottom edge of the first line record layer overlaps the top edge of the second line record layer. Afterwards, the recording operation control section 30 causes the sheet feed motor 25 to be driven to transport the record sheet P by an amount corresponding to the number of dots which is slightly less than that corresponding to one line, after which a recording operation is carried out. A third line record layer is formed so that the bottom edge of the second line record layer overlaps the top edge of the third line by an amount corresponding to a few number of dots. The transporting of the record sheet P by the number of dots which is slightly less than that corresponding to one line is subsequently repeated, whereby record layers along one line are successively formed in the direction of a record sheet line. When the last line of the record sheet P has been transported between the thermal head 5 and the platen 2, the recording edge correcting section 31 corrects the heating area of the thermal head 5 to a size equal to four-sixth of one line, whereby the final underlying ink layer is formed along four-sixth of one line.

Figure 7:
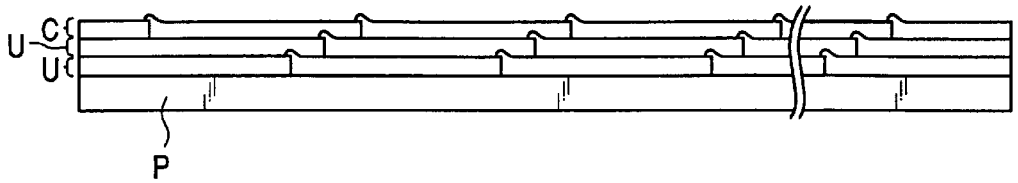
FIG. 7 illustrates a state in which the recording operations using the cyan ink ribbon are completed, in the first embodiment of the thermal transfer printer in accordance with the present invention.

As shown in FIG. 7, this causes the boundaries between adjacent underlying ink layers, formed by the second set of underlying ink transferring operations, and the boundaries between adjacent cyan record layers to be disposed one-sixth of one line apart. The recording operations carried out using the cyan ink ribbon are completed.

In the case where recording operations are carried out using the magenta ink ribbon, the yellow ink ribbon, and the black ink ribbon, the heating amount of the thermal head 5 is corrected by the recording edge correcting section 31, and the amount by which the record sheet P is transported is controlled by the recording operation control section 30, as has been the case when carrying out recording operations using the cyan ink ribbon. Recording operations are carried out such that the boundaries between adjacent record layers, formed by their respective recording operations are one-sixth of one line apart.

According to the first embodiment, it is possible to change the number of underlying ink transferring operations in accordance with the type of record sheet P. In addition, it is possible to form the underlying ink layers so that the boundaries between adjacent underlying ink layers of a layer level and the boundaries between adjacent underlying ink layers of another layer level are formed out of line. Further, it is possible to form the underlying ink layers and the record layers such that the boundaries between the underlying ink layers, formed by the two sets of underlying ink transferring operations, and the boundaries between adjacent record layers formed by the sets of recording operations are formed out of line. Therefore, a high quality recorded image can be obtained.

Although in the embodiment all of the boundaries between adjacent underlying ink layers and all of the boundaries between adjacent record layers are formed out of line, the present invention is not limited thereto. A sufficiently high quality image can be obtained, when at least the boundaries between adjacent topmost underlying ink layers and the boundaries between adjacent record layers formed by the first set of recording operations are formed out of line.

A description will now be given of a second embodiment of the thermal transfer printer in accordance with the present invention.

The component parts of the thermal transfer printer of the second embodiment (thermal transfer printer 33) are basically the same as those of the thermal transfer printer of the first embodiment (thermal transfer printer 1). Corresponding parts to those of the first embodiment are given the same reference numerals.

Figure 8:
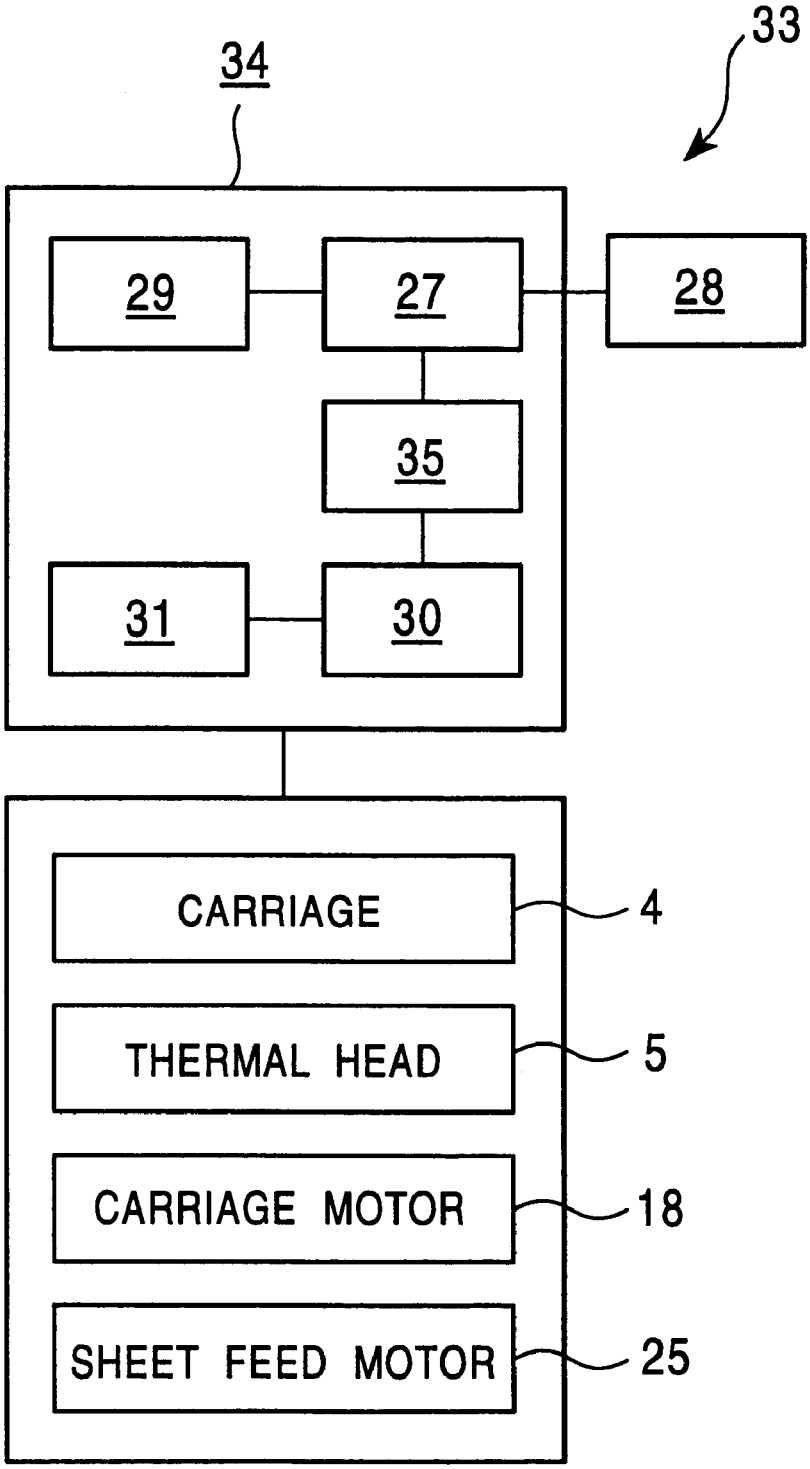
FIG. 8 is a block diagram of the component parts of the means for controlling underlying ink layer operations and recording operations, in a second embodiment of the thermal transfer printer in accordance with the present invention.

As shown in FIG. 8, the control unit 34 of the thermal transfer printer 33 comprises, in addition to the component parts of the control unit 26 used in the first embodiment, a memory 35 for storing the amount by which a record sheet P is transported and the amount by which the heating area of the thermal head 5 is corrected when underlying ink layers are formed, by an underlying ink layer edge correcting section. (The heating area correction amount is hereinafter referred to as "edge correction amount"). When one set of underlying ink transferring operations is carried out, the memory 35 is used to store the amount by which the record sheet P is transported. When a plurality of sets of underlying ink transferring operations are to be carried out, the memory 35 is used to store the amount by which the record sheet P is transported and the edge correction amount when the topmost underlying ink layers and the underlying ink layers therebelow are formed. When a recording operation is performed with the yellow ink ribbon 6, the recording operation control section 30 reads out the amount by which the record sheet P is transported during formation of the topmost underlying ink layers, in order to cause the sheet feed motor 25 to rotate the transporting roller 19 by the transporting amount. The recording operation control section 30 also reads out the edge correction amount when the topmost underlying ink layers are to be formed, in order to heat an area of the thermal head corresponding to the edge correction amount. Further, the recording operation section 30 controls the recording operations such that the different types of ink ribbons 6 are used in the correct order, or, more specifically, such that the topmost first underlying ink layer is formed by a recording operation using an ink ribbon 6 other than the yellow ink ribbon 6. When a recording operation is carried out using the black ink ribbon 6, the recording operation control section 30 reads out the amount by which the record sheet P is transported when underlying ink layers below the topmost underlying ink layers are to be formed, in order to cause the sheet feed motor 25 to rotate the transporting roller 19 by the transporting amount. The recording operation control section 30 also reads out the edge correction amount when underlying ink layers below the topmost underlying ink layers are to be formed, in order to heat an area of the thermal head 5 corresponding to the read out correction amount.

A description will now be given of a thermal transfer recording method carried out by the thermal transfer printer of the second embodiment in accordance with the present invention.

Information indicating the type of record sheet P (such as information indicating the record sheet P is a postcard) is input by the record sheet mode input switch 28. Then, the input information is output to the underlying ink transferring operation control section 27, which determines the optimum number of underlying ink transferring operations to be carried out on the record sheet P. In the embodiment, two sets of underlying ink transferring operations are carried out.

The underlying ink transferring operation control section 27 causes the carriage 4 to move along the platen 2 as a result of driving the carriage motor 18. When the photosensor 13 detects a ribbon cassette 8U, the carriage motor 18 stops. At this time, one cassette accommodating mechanism, in which the ribbon cassette 8U is accommodated, is disposed above the carriage 4. Then, the underlying ink transferring operation control section 27 causes the upper carriage portion 4*a* to move upward as a result of driving the cassette receiving mechanism provided at the carriage 4, after which the ribbon cassette 8U is placed on the cassette placing surface 9.

Thereafter, the underlying ink transferring operation control section 27 causes the transporting roller 19 to rotate as a result of driving the sheet feed motor 25. The first line of the record sheet P (to be subjected to underlying ink transferring operations) is transported between the platen 2 and the thermal head 5. After the record sheet P has been transported, the carriage 4 is moved along the platen 2 as a result of driving the carriage motor 18, while the thermal head 5 is press-contacted against the platen 2. Here, the ink ribbon 6U and the recording sheet P are nipped between the thermal head 5 and the platen 2. The control section 27 causes heating elements of the thermal head 5 located within an area corresponding to one line to be heated in order to cause the ink of the ink ribbon 6U to be thermally transferred onto the record sheet P. This forms an underlying ink layer along one line, on the first line of the record sheet P.

Figure 9:
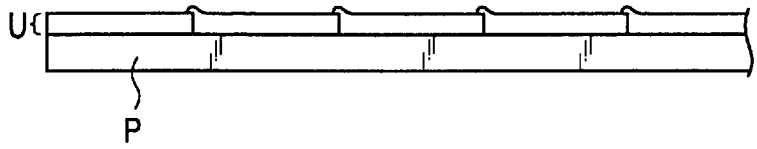
FIG. 9 illustrates a state in which the first set of underlying ink transferring operations is completed, in the second embodiment of the thermal transfer printer in accordance with the present invention.

When the first line underlying ink layer is formed, the underlying ink transferring operation control section causes rotation of the sheet feed roller 19 as a result of driving the sheet feed motor 25. The recording sheet P is transported, by an amount corresponding to the number of dots which is slightly less than that corresponding to one line, in order to move the second line of the record sheet P between the platen 2 and the thermal head 5. While the thermal head 5 is press-contacted against the platen 2 (with the ink ribbon 6U and the record sheet being nipped therebetween), the carriage motor 18 is driven to move the carriage 4 along the platen 2. The heating elements within a predetermined area of the thermal head are heated in order to thermally transfer the ink of the ink ribbon 6 onto the record sheet P. Accordingly, an underlying ink layer is formed along one line, on the second line such that the bottom edge of the first line underlying ink layer overlaps the top edge of the second line underlying ink layer by an amount corresponding to a few dots. These operations are repeated to complete a first set of underlying ink transferring operations performed on the record sheet P, whereby ends of adjacent underlying ink layers overlap each other in the vertical direction, where boundaries between the underlying ink layers disposed adjacent each other in a direction perpendicular to the direction of a record sheet line are formed, as shown in FIG. 9.

The memory 35 is used to store the amount by which the record sheet P is transported when the first set of underlying ink layer operations is carried out.

Figure 10:
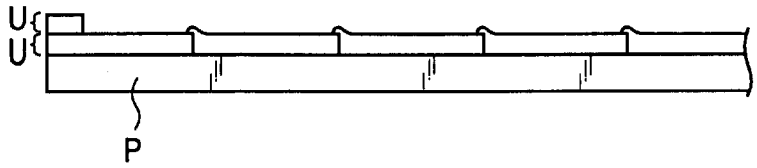
FIG. 10 illustrates a state in which the first layer is formed during a second set of underlying ink transferring operations, in the second embodiment of the thermal transfer printer in accordance with the present invention.

After completion of the first set of underlying ink transferring operations on the record sheet P, the control section 27 causes the record sheet P to be transported in a direction opposite to the transporting direction of the record sheet P as a result of driving the sheet feed motor 25, in order to return the portion of the record sheet P where the first line underlying ink layer is formed between the thermal head 5 and the platen 2. While the thermal head 5 is press-contacted against the platen 2 (with the ink ribbon 6U and the record sheet P being nipped therebetween), the carriage 4 is moved along the platen 2 as a result of driving the carriage motor 18. At this time, the control section 27 causes heating elements located within a predetermined area of the thermal head 5 to be heated in order to thermally transfer the ink of the ink ribbon 6 onto the record sheet P. Here, the predetermined heating area of the thermal head 5 is corrected by the underlying ink layer edge correcting section 29 to, for example, a size corresponding to one-fourth of a line. As shown in FIG. 10, this causes ink to be thermally transferred onto the top of the first line underlying ink layer, formed during the first set of underlying ink transferring operations, with an area corresponding to one-fourth of one line from the left end in FIG. 10.

Thereafter, the underlying ink transferring operation control section 27 causes the transporting roller 19 to rotate as a result of driving the sheet feed motor 25, in order to transport the record sheet P by an amount corresponding to the number of dots which is slightly less than the number of dots corresponding to one-fourth of one line. While the thermal head 5 is press-contacted against the platen 2 (with the ink ribbon 6U and the record sheet P being nipped therebetween), the carriage 4 is moved along the platen 2 as a result of driving the carriage motor 18, and the thermal head 5 is heated to thermally transfer the ink of the ink ribbon 6 onto the record sheet P. This causes an underlying ink layer to be formed on the second line such that, at the boundary between the first line underlying ink layer and the second line underlying ink layer, edges of the first line and the second line underlying ink layers overlap each other in the vertical direction by an amount corresponding to a few number of dots. Then, the control section 27 causes the record sheet P to be transported by the number of dots which is less than that corresponding to one line as a result of driving the sheet motor 25, in order to carry out another underlying ink transferring operation. This causes a third line underlying ink layer to be formed along one line so that the bottom edge of the second line underlying ink layer overlaps the top edge of the third line underlying ink layer. The transportation of the record sheet P by an amount corresponding to the number of dots which is less than one line is subsequently repeated, whereby underlying layers are successively formed along one line. After the last line of the record sheet P has been transported between the thermal head 5 and the platen 2, the underlying ink layer edge correcting section 29 corrects the heating area of the thermal head 5 to a size corresponding to three-fourths of one line, whereby the last underlying ink layer is formed along three-fourths of one line.

Figure 11:
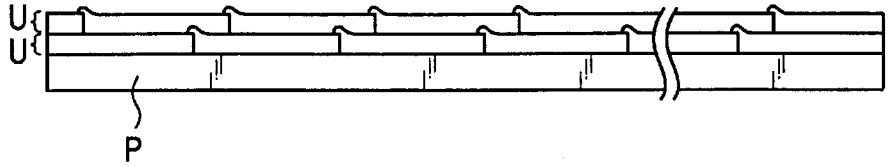
FIG. 11 illustrates a state in which the second set of underlying ink transferring operations is completed, in the second embodiment of the thermal transfer printer in accordance with the present invention.

As shown in FIG. 11, when the second set of underlying ink transferring operations are completed, the second line underlying ink layer is formed such that the boundaries between adjacent underlying ink layers, formed by the first set of underlying ink transferring operations, and the boundaries between adjacent underlying ink layers, formed by the second set of underlying ink transferring operations, are one-fourth of one line apart. The starting location and the ending location of the first and second sets of underlying ink transferring operations are in line, respectively.

The amount by which the record sheet P is transported and the edge correction amount in the second set of underlying ink layer operations is stored in the memory 35.

A description will now be given of recording operations performed on the record sheet P, which has been subjected to the first and the second sets of underlying ink transferring operations using ink ribbon 6U.

The recording operation control section 30 functions to cause a first set of recording operations to be carried out by an ink ribbon 6 other than the yellow ink ribbon 6. In the embodiment, recording operations are carried out using the magenta ink ribbon 6, the yellow ink ribbon 6, and the block ink ribbon 6, in the order specified.

The recording operation control section 30 causes the carriage 4 to be moved along the platen 2 as a result of driving the carriage motor 18. When the photosensor 13 detects the cyan recording ribbon cassette 8, the carriage motor 18 stops. Here, one cassette accommodating mechanism, in which the cyan recording ribbon cassette 8 is accommodated, is disposed above the carriage 4. The recording operation control section 30 then causes the cassette receiving mechanism provided at the carriage 4 to be driven in order to place the cyan recording ribbon cassette 8 on the cassette placing surface 9.

Figure 12:
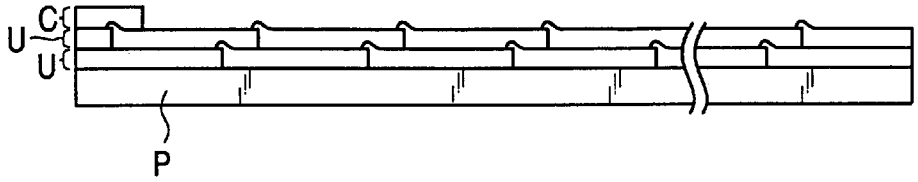
FIG. 12 illustrates a state in which the first line layer is formed using the cyan ink ribbon, in the second embodiment of the thermal transfer printer in accordance with the present invention.

Thereafter, the control section 30 causes the transporting roller 19 to rotate as a result of driving the sheet feed motor 25, in order to transport the first line of the record sheet P back between the platen 2 and the thermal head 5. After the record sheet P has been transported, the carriage 4 is moved along the platen 2 as a result of driving the carriage motor 18, while the thermal head 5 is press-contacted against the platen 2 (with the cyan ink ribbon 6 and the record sheet P being nipped therebetween). At this time, the recording operation control section 30 causes heating elements within a predetermined area of the thermal head 5 to be heated in order to thermally transfer the ink of the cyan ink ribbon 6 onto the record sheet P. Here, the heating area of the thermal head 5 is corrected by the recording edge correcting section 31 to a size corresponding to, for example, one-half of one line. As shown in FIG. 12, the cyan ink is thermally transferred onto underlying ink layers formed by the second set of underlying ink transferring operations so as to be provided with an area equal to one-half of one line from the left end in FIG. 12.

The recording operation control section 30 causes the transporting roller 19 to rotate as a result of driving the sheet feed motor 25, in order to transport the record sheet p by an amount corresponding to the number of dots which is slightly less than that corresponding to one-sixth of one line. Then, while the thermal head 5 is press-contacted against the platen 2 (with the ink ribbon 6 and the record sheet P nipped therebetween), the control section 30 causes the carriage 4 to move along the platen 2 as a result of driving the carriage motor 18. Thereafter, heating elements of the thermal head 5 are heated in order to thermally transfer the ink of the ink ribbon 6 onto the record sheet P. This causes a second line record layer to be formed such that the bottom edge of the first line record layer overlaps the top edge of the second line record layer. Afterwards, the recording operation control section 30 causes the sheet feed motor 25 to be driven to transport the record sheet P by an amount corresponding to the number of dots which is slightly less than that corresponding to one line, after which another recording operation is carried out. This causes a third line to be formed so that the bottom edge of the second line record layer overlaps the top edge of the third line by an amount corresponding to a few dots. The transporting of the record sheet P by the number of dots which is slightly less than that corresponding to one line is subsequently repeated, whereby recording layers are successively formed along one line in the direction of a record sheet line. When the last line of the record sheet P has been transported between the thermal head 5 and the platen 2, the recording edge correcting section 31 corrects the heating area of the thermal head 5 to a size equal to one-half of one line, whereby the last underlying ink layer is formed along one-half of one line.

Figure 13:
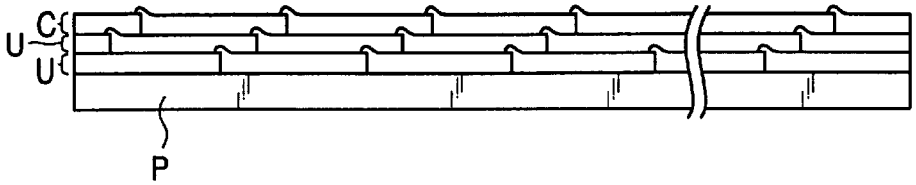
FIG. 13 illustrates a state in which the recording operations using the cyan ink ribbon are completed, in the second embodiment of the thermal transfer printer in accordance with the present invention.
Figure 14:
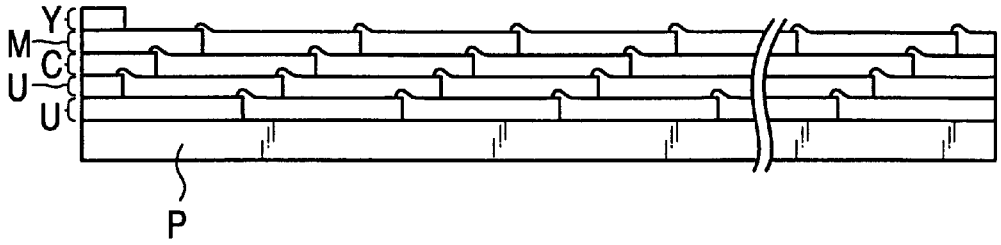
FIG. 14 illustrates a state in which the first line layer is formed using the yellow ink ribbon, in the second embodiment of the thermal transfer printer in accordance with the present invention.

As shown in FIG. 13, this causes the boundaries between adjacent underlying ink layers formed by the second set of underlying ink transferring operations and the boundaries between adjacent cyan record layers to be one-fourth of one line apart. The recording operations carried out using the cyan ink ribbon are completed.

In the case where recording operations are carried out using the magenta ink ribbon, the heating amount of the thermal head 5 is corrected by the recording edge correcting section 31, and the amount by which the record sheet P is transported is controlled by the recording operation control section 30, as has been the case when carrying out recording operations using the cyan ink ribbon. Recording operations are carried out such that the boundaries between adjacent record layers formed by their respective sets of recording operations are one-fourth of one line apart.

When the recording operations using the magenta ink ribbon are completed, the sheet feed motor 25 is driven to transport the record sheet P in a direction opposite to the sheet transporting direction, whereby the first line of the record sheet P returns to the location between the thermal head 5 and the platen 2. After the yellow recording ribbon cassette 8 has been placed on the carriage 4, the carriage 4 is moved along the platen 2 as a result of driving the carriage motor 18, while the thermal head 5 is press-contacted against the platen 2 (with the yellow ink ribbon and the record sheet P being nipped therebetween).

At this time, the recording operation control section 30 reads out the amount by which the record sheet P is transported and the edge correction amount when the second set of underlying ink transferring operations are carried out to form the topmost underlying ink layers. Then, the recording operation control section 30 causes the heating elements disposed within an area formed in correspondence with the first line record layer in order to thermally transfer the yellow ink onto an area of the leftmost magenta record layer equal to one-fourth of one line from the left end in FIG. 14.

The recording operation control section 30 causes the sheet feed motor 25 to rotate the transporting roller 19 by the transporting amount read out from the memory 35 in order to transport the record sheet P in the sheet transporting direction by an amount corresponding to the number of dots which is slightly less than that corresponding to one-fourth of one recording line. While the thermal head 5 is press-contacted against the platen 2 (with the yellow ink ribbon 6 and the record sheet P nipped therebetween), the carriage 4 is moved along the platen 2 as a result of driving the carriage motor 18. Then, the recording operation control section 30 causes the heating elements of the thermal head 5 disposed within an area corresponding to one recording line to be heated in order to thermally transfer the ink of the yellow ink ribbon 6 onto the record sheet P. This causes the second line recording layer to be formed such that the bottom edge of the first line recording layer and the top edge of the second line recording layer overlap by an amount corresponding to a few number of dots. Then, the recording operation control section 30 causes the sheet feed motor 25 to be driven, in accordance with the transporting amount read out from the memory 30, in order to transport the record sheet P by an amount corresponding to the number of dots which is slightly less than that corresponding to one line, and to subject it to a recording operation. This causes a third line recording layer to be formed such that the bottom edge of the second line record layer and the top edge of the third line record layer overlap by an amount corresponding to a few number of dots. Record layers are subsequently carried out along one line in the direction of a record sheet line, by repeatedly and successively transporting the record sheet P by an amount corresponding to the number of dots which is slightly less than that corresponding to one line, in accordance with the sheet transporting amount read out from the memory 35. When the last line of the record sheet P is transported between the thermal head 5 and the platen 2, the last yellow record layer, extending along three-fourths of one line, is formed, by controlling the heating elements of the thermal head 5, disposed within an area corresponding to three-fourths of one line, in accordance with the edge correction amount at the last underlying ink layer, read out from the memory 35.

Figure 15:
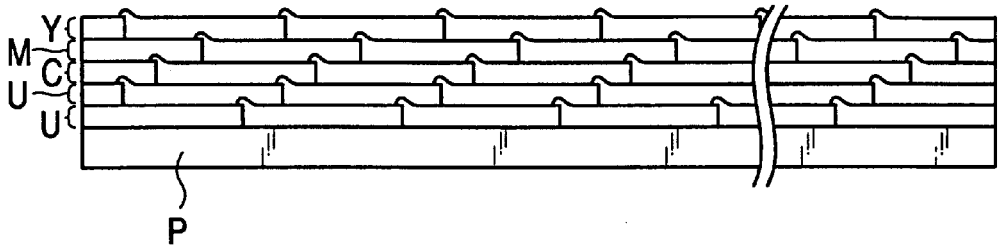
FIG. 15 illustrates a state in which the recording operations using the yellow ink ribbon are completed, in the second embodiment of the thermal transfer printer in accordance with the present invention.

As shown in FIG. 15, when the recording operations using the yellow ink ribbon are completed, the boundaries between adjacent underlying ink layers formed by the second set of underlying ink transferring operations and the boundaries between adjacent record layers formed by the recording operations using the yellow ink ribbon are formed in line. Since it is more difficult for human beings to distinguish between different shades of yellow than between different shades of cyan or magenta, the boundaries between adjacent yellow record layers and the boundaries between adjacent underlying ink layers formed by the second set of underlying ink transferring operations can be formed out of line in the vertical direction, without affecting the quality of the recorded image. The recording operations carried out using the yellow ink ribbon can be easily controlled, since the record sheet P transporting amount and the heating range of the thermal head 5, both of which are stored in the memory 35, can be used.

When the recording operations using the yellow ink ribbon 6 are completed, the sheet feed motor 25 is driven to transport the record sheet P in a direction opposite to the sheet transporting direction. This causes the first line of the record sheet P to return to the location between the thermal head 5 and the platen 2. After the black ribbon cassette 8 has been placed on the carriage 4, the carriage 4 is moved along the platen 2 as a result of driving the carriage motor 18, while the thermal head 5 is press-contacted against the platen 2 (with the black ribbon 6 and the record sheet P being nipped therebetween).

The recording operation control section 30 causes the amount by which the record sheet P is transported, when the first set of underlying ink layer operations is carried out to form the underlying ink layers below the topmost portions, to be read out. Then, the recording operation control section causes heating elements of the thermal head 5 to be heated in order to thermally transfer the black ink on the associated yellow record layer, along one line.

The recording operation control section 30 causes the sheet feed motor 25 to rotate the transporting roller 19 by an amount corresponding to the transporting amount read out from the memory 35. This causes the record sheet P to be transported in the transporting direction by an amount corresponding to the number of dots which is slightly less than that corresponding to one line. Then, the carriage 4 is moved along the platen 2 as a result of driving the carriage motor 18, while the thermal head 5 is press-contacted against the platen 2 (with the black ink ribbon 6 and the record sheet P being nipped therebetween), in order to thermally transfer the ink of the black ink ribbon 6 onto the record sheet P. This causes a second line record layer to be formed such that the bottom edge of the first line record layer and the top edge of the second line record layer overlap by an amount corresponding to a few number of dots. Thereafter, in accordance with the transporting amount of the record sheet P read out from the memory 35, the record sheet P is subsequently and repeatedly transported by an amount corresponding to the number of dots which is slightly less than that corresponding to one line, in order to repeatedly form record layers extending along one line.

Figure 16:
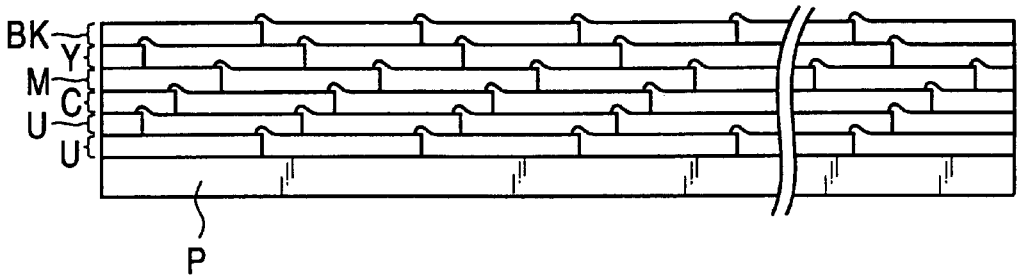
FIG. 16 illustrates a state in which the recording operations using the black ink ribbon are completed, in the second embodiment of the thermal transfer printer in accordance with the present invention.

After the formation of the record layers have been repeated, the recording operations using the black ink ribbon 6 are completed. Here, as shown in FIG. 16, the boundaries between adjacent underlying ink layers formed by the first set of underlying ink transferring operations and the boundaries between adjacent black record layers are formed in line, with the record layers of the plurality of layer levels and the underlying ink layers formed by the second set of underlying ink transferring operations being disposed therebetween.

Since the area subjected to recording by the black ink ribbon 6 is small compared to the area subjected to recording by the cyan and the magenta ink ribbons 6, when the boundaries are formed in line, the image quality is not affected. In addition, when recording is carried out using the black ink ribbon, the record sheet P transporting amount and the edge correction amount (when the underlying ink layers are formed) stored in the memory 35 can be used, so that the recording operations can be easily controlled. Therefore, in the second embodiment, the number of underlying ink transferring operations can be changed in accordance with the type of record sheet P. In addition, the boundaries between adjacent underlying ink layers formed by the second set of underlying ink transferring operations and the boundaries between adjacent yellow record layers can be formed in line. Similarly, as mentioned above, the boundaries between adjacent underlying ink layers formed by the first set of underlying ink transferring operations and the boundaries between adjacent black record layers can be formed in line. Therefore, the image quality can be maintained, and the controlling operations, carried out during underlying ink transferring operations and recording operations, can be simplified.

The present invention is not limited to the first and second embodiments, so that various modifications can be made, when necessary.

In the first and second embodiments, the top and the bottom edges of underlying ink layers and the top and bottom edges of record layers are made to overlap by an amount corresponding to a few number of dots, by controlling the amount by which the record sheet P is transported. However, the present invention is not limited thereto. For example, when a thermal head comprising heating elements disposed in an area larger than that corresponding to one line, in the direction of a record sheet line, is used, the top and the bottom edges of underlying ink layers and the top and the bottom edges of record layers can be made to overlap by an amount corresponding to a few number of dots, by controlling the heating range of the thermal head while controlling the record sheet P transporting amount at a constant value.

In the first and second embodiments, the amount by which the record sheet p is transported is controlled such that the top and the bottom edges of underlying ink layers and the top and the bottom edges of record layers overlap. However, the present invention is not limited thereto. In accordance with the type of record sheet p or recording information, the amount by which the record sheet P is transported or the heating range of the thermal head 5 can be controlled such that the top and the bottom edges of underlying ink layers and the top and the bottom edges of record layers are slightly separated from each other.

Figure 17:
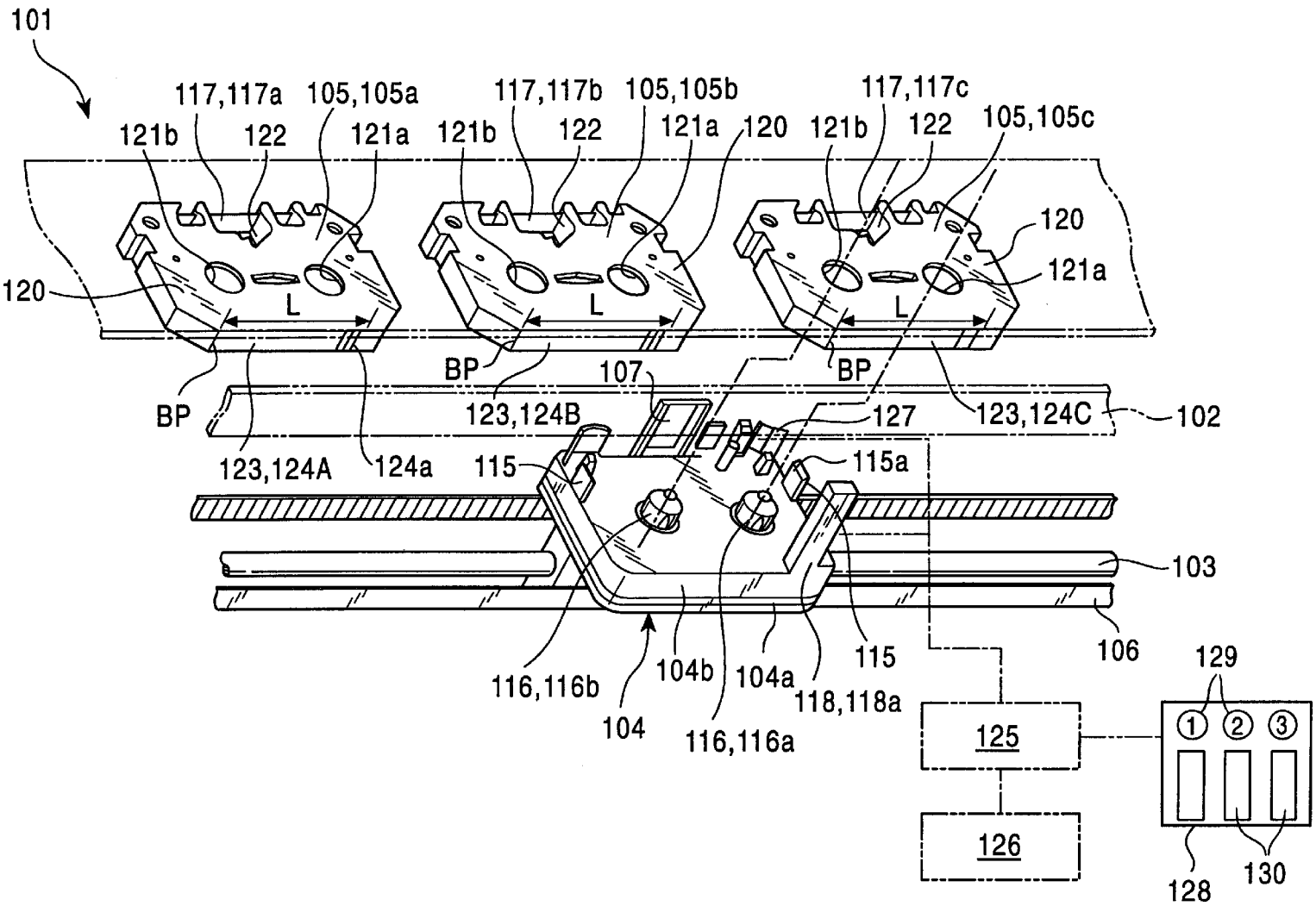
FIG. 17 is a perspective view of a third embodiment of the thermal transfer printer in accordance with the present invention.

FIG. 17 illustrates a third embodiment of the thermal transfer printer in accordance with the present invention. In the thermal transfer printer 101, a tabular platen 102 is disposed at a predetermined location of a frame (not shown) such that a surface 102*a*, facing the side where printing is performed, extends in a substantially vertical direction. A guide shaft 103 is disposed forwardly of and below the platen 102 so as to extend parallel thereto. A carriage 104 is movably supported by the guide shaft 103. It has an upper carriage portion 104*b* and a lower carriage portion 104*a*, supported by the guide shaft 103. An ink ribbon cassette, accommodating an ink ribbon, to be described later, is placed on the upper carriage portion 104*b* which can come into contact with and separate from the lower carriage portion 104*a* in the vertical direction.

The carriage 104 is driven so that it can reciprocate along the guide shaft 103 as a result of driving a suitable driving belt 106, wound around a pair of pulleys (not shown), by a driving means (not shown), such as a stepping motor.

A thermal head 107 is carried by the carriage 104. It can freely come into contact with and separate from the platen 102 by means of a conventionally known head moving mechanism (not shown) which can be moved by the driving power of a driving motor (not shown). When the thermal head 107 is brought into contact with the platen 102 so that it is pressed against it (in other words, when the thermal head 107 is in a head down state), a printing operation is performed on an image receiving sheet transported along the platen 102. The thermal head 107 comprises a plurality of heating elements (not shown) which are selectively heated based on a predetermined print information input by a suitable input device (not shown) such as a keyboard.

A control section 125 (described later) selectively controls the energization energy applied to the thermal head in fifteen steps, that is selectively controls the energization time of the heating elements in fifteen steps.

Figure 19:
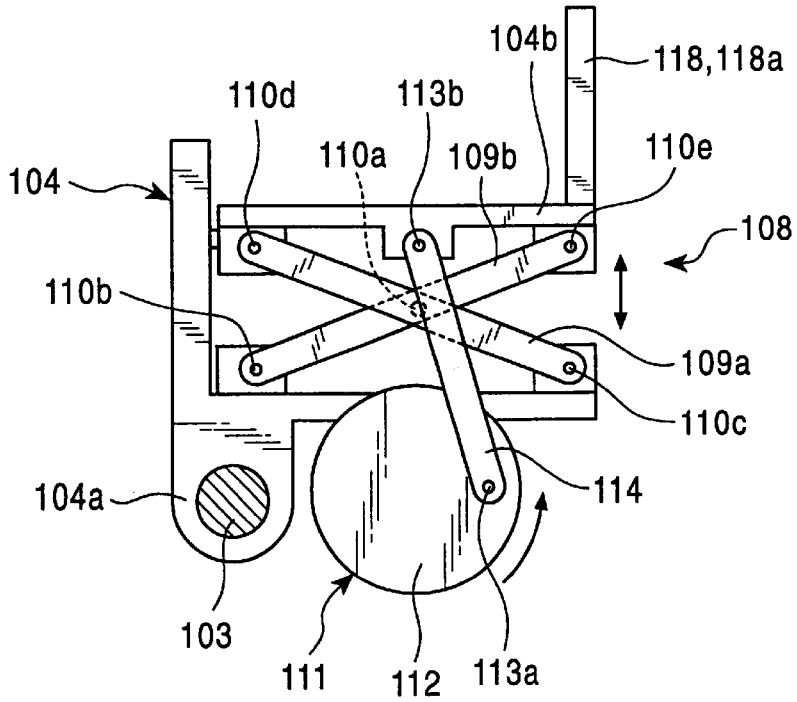
FIG. 19 is a side view showing in detail the parallel crank mechanism and the rotary crank mechanism of FIG. 17.

The carriage 104 will be described in more detail. The planar upper carriage portion 104*b*, which extends substantially parallel to the top surface of the bottom carriage portion 104*a*, is mounted so that it can move freely in parallel by means of parallel crank mechanisms 108, which allow the upper carriage portion 104*b* to come into contact with and separate from the lower carriage portion 104*a*. As shown in FIG. 19, the parallel crank mechanisms 108 are provided on the left and the right ends of the carriage 104, each of which comprises a pair of links 109*a* and 109*b* which cross each other so as to be placed crosswise. Each link 109*a* and its associated link 109*b* are pivotally mounted at the location where they cross by a pin 110*a* associated thereto. Then ends of each link 109*a* and the ends of each link 109*b* are slidably secured in corresponding slots (not shown), formed in the top end of the left and right side portions of the lower carriage portion 104*a* and the upper carriage portion 104*b*, by corresponding pins 110*b*, 110*c*, 110*d*, and 110*e*.

A rotary crank mechanism 111 is disposed at the lower carriage portion 104*a* in order to move the upper carriage portion 104*b* in parallel. The rotary crank mechanism 111 comprises a rotary plate 112 and a connecting link 114. The rotary plate 112, being a rotary member, is supported by the lower carriage portion 104*a* so that it can rotate as a result of a driving operation. The connecting link 114, being a linking member, is pivotally mounted at a portion of the rotary plate 112 located away from the center thereof. One end of the connecting link 114 is pivotally mounted, by a pin 113*a*, to the upper carriage portion 104*b* by a pin 113*b*. The rotary plate 112 is rotated by a suitable driving means (not shown) such as a motor.

Referring back to FIG. 17, plate-shaped arms 115 are formed in a standing manner on the left and right sides of the upper carriage portion 104*b* so as to be separated by a distance equal to about the width of a ribbon cassette 105. Each arm 115 has an engaging portion 115*a* with protruding upper and lower ends. One end of each engaging portion 115*a* gently curves inward. A pair of rotatable bobbins 116 are disposed so as to protrude upward from portions of the upper carriage portion 104*b* lying on a line extending from the center point of a side of the upper carriage portion 104*b* extending in the widthwise direction to the center point of the other side of the upper carriage portion 104*b* extending in the widthwise direction. The bobbins 116 are separated by a predetermined distance. The bobbins 116 allow an ink ribbon 117 to run in a predetermined direction. The bobbin used to supply an ink ribbon 117 is called supply bobbin 116*a*, while the bobbin used to take up the ink ribbon 117 is called take-up bobbin 116*b*. A sensor 118 (or photosensor 118*a*), for detecting the type of ink ribbon 117 housed in a ribbon cassette 105, is disposed at the edge of the carriage 104 located at the far side of the platen 102. In the embodiment, the photosensor 118*a* is a reflecting type photosensor, which is connected to the control section 125 which is disposed at a predetermined location of the thermal transfer printer 101, and controls, for example, the printing operation carried out by the thermal transfer printer 101.

Figure 18:
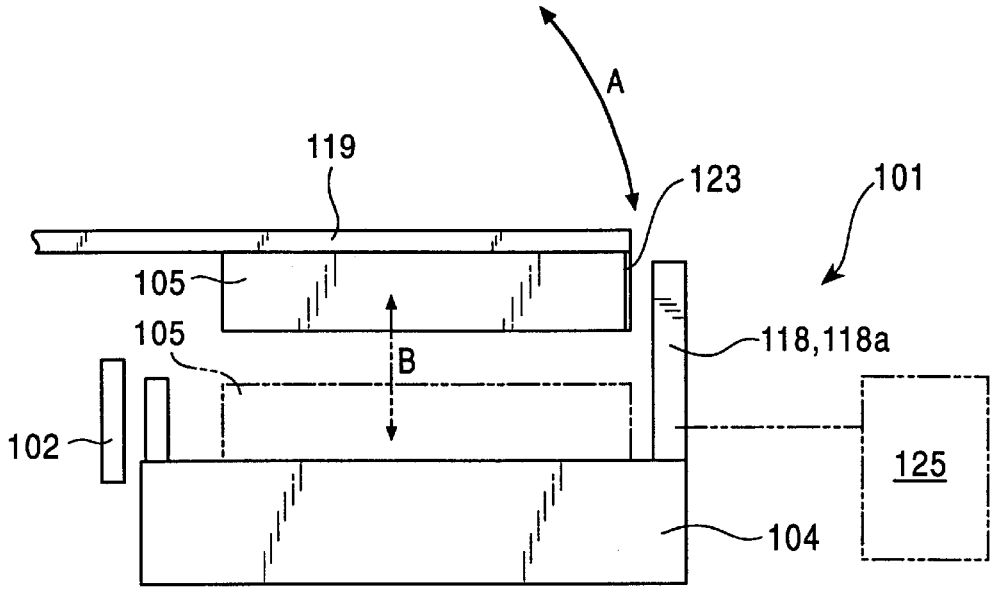
FIG. 18 is a side view showing in detail the portion of the thermal transfer printer including the carriage and component parts therearound.

As shown in FIGS. 17 and 18, a substantially plate-shaped canopy is disposed above the carriage 10 so as to be separated by a proper distance therefrom. It is supported by a frame (not shown) so as to be movable in the directions of the double-headed arrow A of FIG. 18. When the canopy 119 is in its downward position, it functions as a sheet presser at the exit side of a sheet feed mechanism (not shown). It is disposed so as to face the carriage 104, and is about the same length as the area of movement of the carriage 104.

A plurality of cassette holders (not shown) for holding ribbon cassettes 105 are disposed at a predetermined location below the side of the canopy 119 facing and extending parallel to the carriage 104. Three ribbon cassettes 105, in which three types of ink ribbons 117*a*, 117*b*, and 117*c* are independently accommodated, are disposed in the cassette holders in a row in the direction of movement of the carriage 104.

Figure 20:
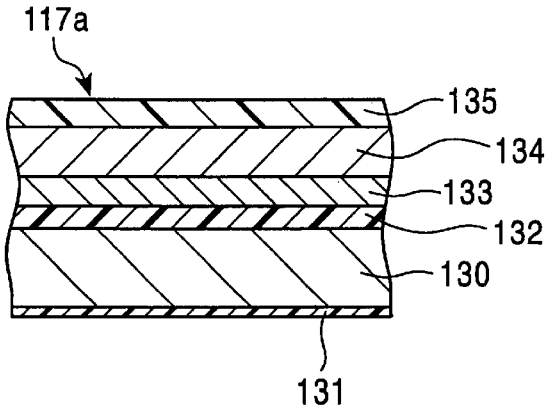
FIG. 20 is a vertical sectional view of an underlying ink printing ink ribbon.

Of the ink ribbons 117*a*, 117*b*, and 117*c*, the ink ribbon 117*a* is used to print an underlying ink layer with a transparent or white ink. As shown in FIG. 20, the ink ribbon 117*a* comprises a base 130, which may be a polyethylene terephthalate (PET) film and have a thickness of 4.5 μm. A backing layer 131, which may be formed of a fluororesin and a thickness of 0.3 μm, is placed onto the back side of the base 130. The backing layer 131, which comes into direction contact with the thermal head 107, prevents sticking of the base 130 onto the thermal head 107 due to heat produced by the thermal head 107, and increases slidability between the thermal head 107 and the ink ribbon 117*a*.

A separation layer 132, which may be formed of a resinous material and have a thickness of 0.2 μm, is placed on the side of the base 130 opposite the side where the backing layer 131 is formed. An image receiving layer 133, formed of thermoplastic elastomer and having a suitable thickness, is placed on the side of the separation layer 132 opposite the side where the base 130 is formed to allow the image, formed with color ink, to be properly placed on a record sheet. A white ink layer 134, containing titania and having a suitable thickness, is placed on the side of the image receiving layer 133 opposite the side where the separation layer 132 is formed. The white ink layer 135 acts to hide a photographic image. An adhesion layer formed of a thermoplastic elastomer based material containing a blocking prevention agent as additive, is placed on the side of the white ink layer 134 opposite the side where the image receiving layer 133 is formed. The adhesive layer 134 is provided to allow good adhesion onto a surface of a photographic sheet P. Examples of additives include wax containing additives, high fatty acid amide, esters, and fluororesins.

Although in the embodiment only one ribbon cassette 105*a*, housing an underlying ink printing ink ribbon 117*a*, is used, the thermal transfer printer may be constructed so that it can hold a plurality of ribbon cassettes 115*a*.

Figure 21:
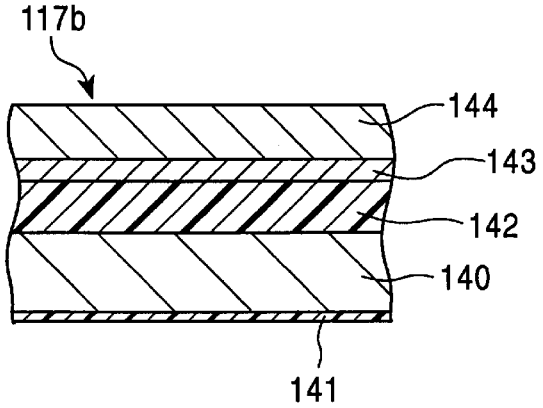
FIG. 21 is a vertical sectional view of an image printing ink ribbon.

The ink ribbon 117*b* is used to print an image on the underlying ink layers. As shown in FIG. 21, the ink ribbon 117*b* comprises a base 140, which may be a polyethylene terephthalate (PET) film and have a thickness of 2.5 μm. A backing layer 141 (whose function is similar to that of the backing layer 131), which may be formed of a silicon material and have a thickness of 0.25 μm, is placed on the back side of the base 140.

A separation layer 142, which may be formed of a wax containing material, is placed on the side of the base 140 opposite the side where the backing layer 141 is formed. An intermediate layer 143, which may be formed of rosin type adhesive property imparting agent and have a thickness of 0.3 μm, may be placed on the side of the separation layer 142 opposite the side where the base 140 is formed. The intermediate layer 143 is provided to allow an overcoat OC (described later) to be properly placed on a record sheet. A coloring ink layer 144, which may be formed of a resin containing material and have a thickness of 1.2 μm, is placed on the side of the intermediate layer 143 opposite the side where the separation layer 142 is formed. The coloring ink layer 144 is provided to form an image.

Figure 22:
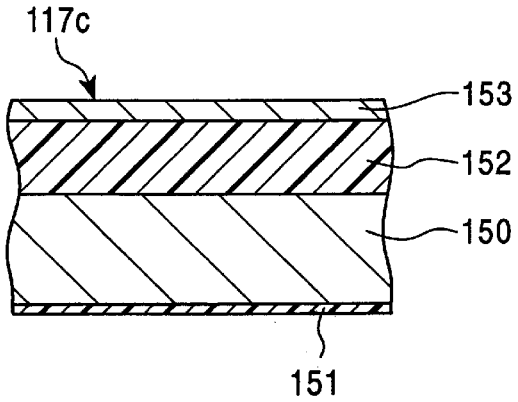
FIG. 22 is a vertical sectional view of an overcoat printing ink ribbon.

The ink ribbon 117*c* is used to form an overcoat on the exposed underlying ink layers and the image in order to prevent, for example, an image to be scraped or rubbed out. As shown in FIG. 22, the ink ribbon 17*c* comprises a base 150, which may be a polyethylene terephthalate (PET) film and have a thickness of 4.5 μm. A backing layer 151 (whose function is similar to that of the backing layers 131 and 141), which is formed of a fluororesin and has a suitable thickness, is placed on the back side of the base 150.

A transparent ink layer 152, formed of a resin containing material and having a suitable thickness, is placed on the side of the base 150 opposite to the side where the backing layer 151 is formed. An adhesive layer 153, which is formed of a material similar to that forming the adhesive layer 135, is placed on the side of the transparent ink layer 152 opposite to the side where the base 150 is formed. The adhesion layer 153 is provided to increase adhesivity between the underlying ink layers and the image.

Figure 23:
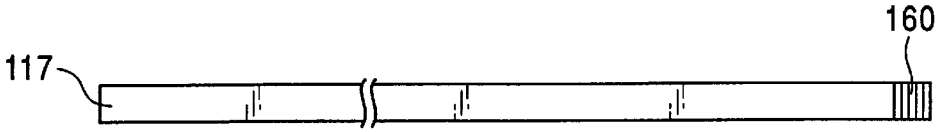
FIG. 23 is a plan view showing a terminal end mark of an ink ribbon.

As shown in FIG. 23, terminal end marks (or stripes) 160 are formed at the terminal end of each of the ink ribbons 117*a* to 117*c*. These end marks 160 are used to detect the end of each of the ink ribbons 117*a* to 117*c*.

Referring back to FIG. 17, a photosensor 127, acting as detecting section for detecting the terminal end mark 160 of each of the ink ribbons 117*a* to 117*c*, is disposed beside the thermal head 107 provided at the lower carriage portion 104*a* of the carriage 104. The photosensor 127 faces an opening (not shown) of a ribbon cassette 105 placed on the upper carriage portion 104*b*, and is connected to the control section 125 of the thermal transfer printer. When the photosensor 127 detects the terminal end mark 160 of a desired ink ribbon 117 housed in the ribbon cassette 105 on the carriage 104, a detection signal is output to the control section 125. A user informing section 126 is provided at the control section 125. When the detection signal has been input into the control section 125 from the photosensor 127, the user informing section 126 makes known to the user by sound or by means of a display that the ribbon end has been detected.

A setting section 128 for setting the number of underlying ink printing operations to be performed at a same location is provided at the control section 125 in order to select the set the number of underlying ink printing operations in accordance with the print sheet type or the print image mode. The setting section 128 comprises a plurality of buttons 129 and indicator portions 130. The plurality of buttons 129, having the number of underlying ink printing operations indicated thereat, are used to set the number of printing operations to be performed. The indicator portions 130 indicates the sheet types or the printing image modes in accordance with the number of underlying ink printing operations indicated at the plurality of buttons 129. The user can set the number of underlying ink printing operations to be performed by pressing the button 129 which corresponds to the indicator portion indicating the sheet type to be used and the print image mode.

Sheet types indicated at the indicator sections 130 include ordinary sheet, postcard, bond sheet, overhead projector sheet, and photographic sheet. Image modes indicated at the indicator sections 130 include heat fusion transfer mode, heat sublimation transfer mode, and other transfer mode types; color type modes such as black color mode, single color mode, and full color mode; and image quality type modes such as sharp image mode and rough image mode.

The number of underlying ink printing operations to be performed, set at the setting section 128 is output to the control section 125, which carries out various control operations when the set number of underlying ink printing operations is carried out.

When the parallel crank mechanisms 108 moves as the rotary crank mechanism 111 moves, each of the ribbon cassettes 105*a* to 105*c* is selectively transferred from the canopy 119 to the upper carriage portion 104*b*, as indicated by the double-headed arrow B of FIG. 18.

Regardless of the type of ink ribbon, the ribbon cassettes 105*a* to 105*c* are formed of the same shape and size. In each planar and substantially rectangular case member 120 are disposed a pair of rotatably supported reels (not shown), a pair of rotatably supported ribbon supply rollers (not shown), and a plurality of rotatably supported guide rollers (not shown) facing the ribbon path. The case member 120 is formed of a pair of upper and lower portions.

Each ink ribbon 117 is wound upon the pair of reels of its associated ribbon cassette 105. The reel which winds up the portion of the ink ribbon 117 which has been subjected to printing is called a take-up reel, whereas the reel which supplies a portion of the ink ribbon 117 is called a supply reel. A plurality of keyways, which are separated from each other, are formed in a peripheral direction along the inner peripheral surface of each reel so as to resemble splines. Each of the ribbon cassettes 105*a* to 105*c* has a take-up hole 121*b*, which engages the take-up bobbin 116*b*, and a supply hole 121*a*, which engages the supply bobbin 116*a*.

When a ribbon cassette 105 is placed on the carriage 104, the intermediate portion of an ink ribbon 117 in the ribbon cassette 105 is lead out from a recess 122 formed at the side of the ribbon cassette 105 facing the platen 102 so as to face the thermal head 107.

Each of the ribbon cassettes 105*a* to 105*c* has an identification mark 123 in order to determine the ink ribbon type of the ink ribbon 117 housed in each of the ribbon cassettes 105*a* to 105*c*. The back surface of each ribbon cassette 105 extends parallel to the surface of each ribbon cassette 105 in which recess 122 is formed. Each identification mark 123 is formed by a reflecting seal 124 having non-reflecting portions or stripes. The number of non-reflecting portions or stripes depends on the type of ink ribbon 117.

The photosensor 118*a*, provided at the carriage 104, is used to detect the identification mark 123 of each of the ribbon cassettes 105*a* to 105*c*. The detection signal is output to the control section 125 of the thermal transfer printer 101. When the number of non-reflecting portions or stripes of the ribbon cassette 105 is counted in the control section 125, the ink ribbon type, housed in the ribbon cassettes 105*a* to 105*c*, can be determined.

More specifically, a reflecting seal 124A, including three non-reflecting portions 124*a*, is provided as identification mark 123 on the leftmost ribbon cassette 105*a* in FIG. 17. The left end of the back surface (disposed towards the front in FIG. 17) of each ribbon cassette 105 is defined as a reference position BP for starting detection of each identification mark 123. The distance L from the reference position BP to the rightmost reflecting portion 124*a* of the identification mark 123 in FIG. 17 is the same for all ribbon cassettes. A predetermined number of nonreflecting portions 124*a* used for determining the ink ribbon type of the ink ribbon 117*a* is formed within the distance L. With the desired identification mark 123 detected by the photosensor 118*a*, the carriage 104 can be stopped. While the carriage 104 is stopped, the ribbon cassette 105s, held by the cassette holder, is transferred to the upper carriage portion 104*b*.

A description will now be given of the thermal transfer printer of the embodiment having the above-described structure.

Voice code information is transmitted from, for example, a host computer to the control section 125 of the thermal transfer printer of the embodiment. When a button 129 (of the setting section 128) for setting the number of underlying ink printing operations is pressed in correspondence with the indicator portion indicating the sheet type and the printing image mode, the number of underlying ink printing operations is input to the control section 125. When the control section gives out a command for carrying out underlying ink printing operations, the carriage 104 is moved to the home position, and the photosensor 118*a*, disposed at the carriage 104, detects the identification mark 123 of a desired ribbon cassette 105. Then, the photosensor 118*a* sends a detection signal characteristic of the identification mark 123 (consisting of, for example, arranged non-reflecting portions 124*a* and pitches) is transmitted to the control section 125, which determines whether or not the identification mark 123 corresponds to the underlying ink printing command. When the identification mark is found to correspond to the underlying ink printing command, the carriage 104 is stopped. In the embodiment, since underlying ink printing, image printing, and overcoat printing operations are carried out in the order specified, the ribbon cassette 105*a* which houses the underlying ink printing ink ribbon 117*a* is identified first.

The selected ribbon cassette 105*a*, which houses the underlying ink layer ink ribbon 117*a*, is selectively transferred from the canopy 119 to the upper carriage portion 104*b*, as indicated by the double-headed arrow B of FIG. 18, by the parallel crank mechanisms 108 and the rotary crank mechanism 111. This causes the ribbon cassette 105*a* to be placed on the carriage 104, whereby selection of the ribbon cassette 105*a* is completed.

At the same time, the sheet, to be subjected to image printing, is set between the platen 102 and the thermal head 107 either manually or using a sheet feed device (not shown) in order to start the underlying ink printing operation. Then, the control section 125 gives out a command to set the thermal head 107 in a "head down" state, and to press-contact it against the platen 102 (with the ink ribbon 117*a* and the sheet nipped between the thermal head 107 and the platen 102), and to move the carriage 104. As the thermal head 107 is moved with respect to the sheet, the heating elements of the thermal head 107 disposed within an area corresponding to the entire area of an image-forming portion are heated. When the heating elements are heated, the thermoplastic elastomer, of which the light-receiving layer 133 is formed, and the white ink of the white ink layer 134 of the ink ribbon 117*a* are separated from the separation layer 132 and transferred onto the sheet. When a plurality of underlying ink printing operations are carried out, the thermal head 107 is set in a "head up" state, without removing the ribbon cassette 105*a*. Then, the carriage 104 is returned to its initial position in order to set the thermal head 107 in the "head down" state. The thermal head 107 is press-contacted against the platen 102 (with the ink ribbon 117*a* and the sheet nipped therebetween), and the carriage is moved to carry out underlying ink printing operations again along the entire area of the image forming portion.

When a plurality of underlying ink printing operations are carried out, the ribbon cassette 105*a*, used for underlying ink printing, is transferred from the upper carriage portion 104*b* to the canopy 119. At the same time, the ribbon cassette 105*b*, which houses the ink ribbon 117*b* used for image printing, is identified. The ribbon cassette 105*b* is transferred onto the upper carriage portion 104*b* from the canopy 119 in order to start the image printing.

The control section 125 gives out a command to set the thermal head 107 in the "head down" state, and to press-contact it against the platen 102 (with the ink ribbon 117*b* and the sheet nipped between the thermal head 107 and the platen 102), and to move the carriage 104. As the thermal head 107 is moved with respect to the sheet, the heating elements of the thermal head 107 used for forming an image are heated. When the heating elements are heated, the rosin type adhesive property imparting agent (of which the intermediate layer 143 is formed) and the coloring ink layer 144 of the ink ribbon 117*b* are separated from the separation layer 142 and transferred onto the sheet subjected to underlying ink printing, whereby the image printing is completed. When a color image is to be printed, there may be used an ink ribbon containing the three primary color ink types provided repeatedly and successively thereon, or a plurality of ribbon cassettes, each separately housing a different one of the three primary color ink types.

When the image printing is completed, the ribbon cassette 105*b*, used for image printing, is transferred from the upper carriage portion 104*b* to the canopy 119. At the same time, the ribbon cassette 105*c*, which houses the ink ribbon 117*c* used for overcoat printing, is identified. The ribbon cassette 117*c* is transferred onto the upper carriage portion 104*b* from the canopy 119 in order to start the overcoat printing.

The control section 125 gives out a command to set the thermal head 107 in the "head down" state, and to press-contact it against the platen 102 (with the ink ribbon 117*c* and the sheet nipped between the thermal head 107 and the platen 102), and to move the carriage 104. As the thermal head 107 is moved with respect to the sheet, the thermal elements of the thermal head 107, formed in correspondence with the entire image and exposed underlying ink layer area, is heated. When the thermal elements are heated, the transparent ink of the transparent ink layer 152 and the thermoplastic elastomer based adhesive of the adhesive layer 153 of the ink ribbon 117*c* are separated from the base 150 and transferred onto the sheet, whereby the overcoat printing, carried out to prevent an image from being scraped or rubbed out, is completed.

When an ink ribbon 117, which is housed in its associated ribbon cassette 105, is used up, and the photosensor 127 detects the terminal end mark 160 thereof, the detection signal is input to the control section 125, and the user informing section 126 makes known to the user by sound or by means of a display that the terminal end mark 160 of the ink ribbon 117 has been detected. When the user is informed that the terminal end mark 160 has been detected, the user should replace the used up ribbon cassette 105 with a new one.

As described above, since the number of underlying ink printing operations can be set in accordance with the print sheet type or printing image mode, an image can be formed on the underlying ink layer, without wasting the underlying ink layer printing ink ribbon 117*a*. Therefore, the formed image is sharp.

The present invention is not limited to the above-described embodiments, so that various modifications may be made as required. For example, three or more underlying printing operations may be carried out. Overcoat printing may be omitted.

According to the thermal transfer recording method in the first aspect and the thermal transfer printer in the fourth aspect of the invention, the number of underlying ink transferring operations can be controlled in accordance with the properties of a recording sheet, and such that the boundaries between adjacent underlying ink layers of each layer level are formed out of line. Therefore, the thermal transfer recording method and the thermal transfer printer are effective in providing a high quality recorded image or the like.

According to the thermal transfer recording method in the second aspect and the thermal transfer printer in the fifth aspect of the present invention, the boundaries between adjacent record layers and the boundaries between adjacent underlying ink layers of a layer level are formed out of line. Therefore, the thermal transfer recording method and the thermal transfer printer are effective in providing a high quality recorded image or the like.

According to the thermal transfer recording method in one form of the first aspect of the present invention, and the thermal transfer printer in one form of the fourth aspect of the present invention, when a plurality of underlying ink transferring operations are carried out, the boundaries between adjacent underlying ink layers of each layer level are formed out of line, so that the thermal transfer recording method and the thermal transfer printer not only provide the advantages provided by the thermal transfer recording method in the first aspect of the present invention and the thermal transfer printer in the fourth aspect of the present invention, but also the advantage of, for example, allowing proper and precise recording on a record sheet, even when a plurality of underlying ink transferring operations are carried out.

According to the thermal transfer recording method in another form of the first aspect of the present invention, and the thermal transfer printer in another form of the fourth aspect of the present invention, at least the boundaries between topmost adjacent underlying ink layers are formed out of line with respect to the boundaries between adjacent record layers placed directly on top of the topmost underlying ink layers. Therefore, in addition to providing the advantages of the thermal transfer recording methods in the first aspect and one form of the first aspect of the present invention and the thermal transfer printers in the fourth aspect and one form of the fourth aspect of the present invention, the thermal transfer recording method in another form of the first aspect of the present invention, and the thermal transfer printer in another form of the fourth aspect of the present invention provide the advantage of, for example, simplifying the controlling operations carried out to control underlying ink transferring operations and recording operations while maintaining the image quality.

According to the thermal transfer recording method in still another form of the first aspect of the present invention, and the thermal transfer printer in still another form of the fourth aspect of the present invention, record layers can be formed such that the boundaries of adjacent record layers of each layer level are formed out of line in the vertical direction, when recording operations are carried out with various types of recording ink ribbons 6. Therefore, in addition to providing the advantages of the thermal transfer recording methods of the first aspect or another form of the first aspect of the present invention, and the thermal printer in the fourth aspect or another form of the fourth aspect of the present invention, the thermal transfer recording method in still another form of the first aspect of the present invention, and the thermal transfer printer in still another form of the fourth aspect of the present invention provides the advantage of, for example, further improving the quality of a recorded image.

According to the thermal transfer recording method in the third aspect of the present invention, and the thermal transfer printer in the sixth aspect of the present invention, the boundaries between adjacent underlying ink layers of a layer level are formed in line with the boundaries between adjacent yellow record layers which come in shades which do not vary very greatly. Therefore, the controlling operations carried out to control underlying ink transferring operations and recording operations can be simplified, while maintaining the image quality.

In addition to the advantages of the thermal transfer recording method in the third aspect of the present invention and the thermal transfer printer in the sixth aspect of the present invention, the thermal transfer recording method in one form of the third aspect of the present invention, and the thermal transfer printer in one form of the sixth aspect of the present invention provide the advantage of simplifying the controlling operations carried out to control underlying ink transferring operations and recording operations while maintaining the image quality, when a plurality of underlying ink transferring operations are carried out.

According to the thermal transfer recording method, in which the first recording operations on the topmost underlying ink layers are carried out using a recording ink ribbon other than the yellow ink ribbon, and the thermal transfer printer, in which a controlling operation is carried out such that the first recording operations on the topmost underlying ink layers are carried out using a recording ink ribbon other than the yellow ink ribbon, the boundaries of adjacent record layers of black ink, which is used in the smallest amount when recording, and the boundaries of adjacent underlying ink layers of each layer level are formed in line with respect to each other. Therefore, in addition to providing the advantages of the thermal transfer recording method in one form of the third aspect of the present invention and the thermal transfer printer in one form of the sixth aspect of the present invention, they provide the advantage of further simplifying the controlling operations carried out to control underlying ink transferring operations and recording operations.

According to the thermal transfer printer in the seventh aspect of the present invention, there are provided a setting section for setting the number of underlying ink printing operations to be carried out on a same location; and a controlling section for carrying out a controlling operation so that the number of underlying ink printing operations set at the setting section is carried out. Therefore, a proper number of underlying ink printing operations can be set to print a sharp image on various types of print sheet.

According to the thermal transfer printer in one form of the seventh aspect of the present invention, the setting section can set the number of underlying ink printing operations in accordance with print sheet types. Therefore, a sharp image can be printed without wasting underlying ink printing ink ribbons.

According to the thermal transfer printer in another form of the seventh aspect of the present invention, the setting section can select the number of underlying ink printing operations in accordance with image types to be printed using predetermined color ink, whereby the number of underlying ink printing operations are set in accordance with the print image mode. Therefore, underlying ink printing operations can be carried out in accordance with the image which needs to be printed.

According to the thermal transfer printer in still another form of the seventh aspect of the present invention, one underlying ink printing ribbon cassette is used to form all of the underlying ink layers by printing with the ribbon cassette. Therefore, the ribbon cassette installation space can be reduced.

According to the thermal transfer printer in still another form of the seventh aspect of the present invention, a plurality of underlying ink printing ribbon cassettes are used to carry out underlying ink printing. Therefore, underlying ink printing ribbon cassettes do not have to be replaced so frequently.

What is claimed is:

1. A thermal transfer recording method, comprising the steps of:

moving a thermal head, comprising a plurality of heating elements, along a platen, while the thermal head is press-contacted against the platen, with an underlying ink transferring ink ribbon and a record sheet disposed between the thermal head and the platen; and after repeatedly thermally transferring ink of the underlying ink transferring ink ribbon onto the record sheet in the direction of a record sheet line, ink of a recording ink ribbon is repeatedly thermally transferred onto the record sheet, which has been subjected to the underlying ink transferring operations, by the thermal head, in the direction of a record sheet line, whereby thermal transfer recording operations are carried out;

wherein the underlying ink transferring operations are carried out a plurality of times layer upon layer in accordance with the properties of the record sheet to form different layer levels of underlying ink layers; and wherein boundaries between adjacent underlying ink layers, in a direction perpendicular to the direction of a record sheet line, of each layer level are formed out of line with respect to each other.

* * * * *

UNITED STATES PATENT AND TRADEMARK OFFICE

CERTIFICATE OF CORRECTION

PATENT NO. : 6,250,824 B1
DATED : June 26, 2001
INVENTOR(S) : Osamu Ogiyama

It is certified that error appears in the above-identified patent and that said Letters Patent is hereby corrected as shown below:

Title page,
Item [56] References Cited "Foreign Application Priority Data", delete "Jun. 30, 1998" and substitute -- Sep. 30, 1998 -- in its place.
Under "FOREIGN PATENT DOCUMENTS" delete "07 309 204" and substitute -- 07 309 024 -- in its place.

Signed and Sealed this

Twenty-eighth Day of May, 2002

*Attest:*

*Attesting Officer*

JAMES E. ROGAN
*Director of the United States Patent and Trademark Office*